US010854214B2

(12) United States Patent
Alves et al.

(10) Patent No.: US 10,854,214 B2
(45) Date of Patent: Dec. 1, 2020

(54) NOISE SUPPRESSION WEARABLE DEVICE

(71) Applicant: QUALCOMM Incorporated, San Diego, CA (US)

(72) Inventors: Rogerio Guedes Alves, Macomb Township, MI (US); Taher Shahbazi Mirzahasanloo, San Diego, CA (US); Erik Visser, San Diego, CA (US); Lae-Hoon Kim, San Diego, CA (US); Fatemeh Saki, San Diego, CA (US); Dongmei Wang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 124 days.

(21) Appl. No.: 16/370,812

(22) Filed: Mar. 29, 2019

(65) Prior Publication Data

US 2020/0312341 A1 Oct. 1, 2020

(51) Int. Cl.

| | |
|---|---|
| ***H04R 1/00*** | (2006.01) |
| ***H04R 3/04*** | (2006.01) |
| ***G10L 21/0208*** | (2013.01) |
| ***G10L 21/02*** | (2013.01) |

(52) U.S. Cl.
CPC ..... *G10L 21/0208* (2013.01); *G10L 21/0202* (2013.01); *G10L 2021/02082* (2013.01)

(58) Field of Classification Search
CPC ..... H04R 1/00; H04R 3/04
See application file for complete search history.

(56) References Cited

U.S. PATENT DOCUMENTS

| | | | | |
|---|---|---|---|---|
| 10,623,843 | B1 * | 4/2020 | Jorgovanovic ..... | H04R 1/1016 |
| 2015/0334489 | A1 * | 11/2015 | Iyengar ..... | H04R 3/04 381/71.6 |
| 2016/0044151 | A1 * | 2/2016 | Shoemaker ..... | H04M 1/7253 455/556.1 |
| 2017/0243602 | A1 * | 8/2017 | Yang ..... | G10L 21/0264 |

* cited by examiner

*Primary Examiner* — Shreyans A Patel
(74) *Attorney, Agent, or Firm* — Moore Intellectual Property Law, PLLC

(57) ABSTRACT

A device includes a memory and one or more processors coupled to the memory. The one or more processors are configured to perform an active noise cancellation (ANC) operation on noisy input speech as captured by a first microphone, the noisy input speech as captured by a second microphone, or both, to suppress a noise level associated with the noisy input speech. The one or more processors are configured to match a second frequency spectrum of a second signal with a first frequency spectrum of a first signal. The first signal is representative of the noisy input speech as captured by the first microphone, and the second signal is representative of the noisy input speech as captured by the second microphone. The one or more processors are also configured to generate an output speech signal that is representative of input speech based on the second signal.

30 Claims, 13 Drawing Sheets

NOISE SUPPRESSION WEARABLE DEVICE

I. FIELD

The present disclosure is generally related to a wearable device.

II. DESCRIPTION OF RELATED ART

Advances in technology have resulted in smaller and more powerful computing devices. For example, a variety of portable personal computing devices, including wireless telephones such as mobile and smart phones, tablets and laptop computers are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A wearable device can wirelessly communicate with a mobile device, such as a mobile phone. A user can speak through the wearable device to communicate during a voice call, to communicate with an application on the mobile device (e.g., a voice assistant application), etc. However, if the user is in a noisy environment or in an environment where there are harsh environmental conditions (e.g., windy conditions), a microphone at the wearable device may not be able to clearly capture what is spoken by the user. As a result, other participants on the voice call may not be able to comprehend what the user is saying, the voice assistant application may not be able to determine what the user is saying, etc.

III. SUMMARY

According to one implementation of the techniques disclosed herein, a device includes a memory and one or more processors coupled to the memory. The one or more processors are configured to perform an active noise cancellation (ANC) operation on noisy input speech as captured by a first microphone, the noisy input speech as captured by a second microphone, or both, to suppress a noise level associated with the noisy input speech as captured by the second microphone. The one or more processors are configured to match a second frequency spectrum of a second signal with a first frequency spectrum of a first signal. The first signal is representative of the noisy input speech as captured by the first microphone, and the second signal is representative of the noisy input speech as captured by the second microphone. The one or more processors are also configured to generate an output speech signal that is representative of input speech based on the second signal having the second frequency spectrum that matches the first frequency spectrum.

According to another implementation of the techniques disclosed herein, a method for suppressing noise associated with speech includes performing an active noise cancellation (ANC) operation on noisy input speech as captured by a first microphone of a wearable device, the noisy input speech as captured by a second microphone of the wearable device, or both, to suppress a noise level associated with the noisy input speech as captured by the second microphone. The second microphone is positioned within a threshold distance of an ear canal of a user. The method also includes performing an equalization operation to match a second frequency spectrum of a second signal with a first frequency spectrum of a first signal. The first signal is representative of the noisy input speech as captured by the first microphone, and the second signal is representative of the noisy input speech as captured by the second microphone. The method further includes generating an output speech signal that is representative of input speech based on the second signal having the second frequency spectrum that matches the first frequency spectrum. The method also includes transmitting a time-domain version of the output speech signal to a mobile device.

According to another implementation of the techniques disclosed herein, a non-transitory computer-readable medium includes instructions for suppressing noise associated with speech. The instructions, when executed by one or more processors within a wearable device, cause the one or more processors to perform an active noise cancellation (ANC) operation on noisy input speech as captured by a first microphone of a wearable device, the noisy input speech as captured by a second microphone of the wearable device, or both, to suppress a noise level associated with the noisy input speech as captured by the second microphone. The second microphone is positioned within a threshold distance of an ear canal of a user. The instructions also cause the processor to perform an equalization operation to match a second frequency spectrum of a second signal with a first frequency spectrum of a first signal. The first signal is representative of the noisy input speech as captured by the first microphone, and the second signal is representative of the noisy input speech as captured by the second microphone. The instructions also cause the processor to generate an output speech signal that is representative of input speech based on the second signal having the second frequency spectrum that matches the first frequency spectrum.

According to another implementation of the techniques disclosed herein, a wearable device includes first means for capturing noisy input speech and second means for capturing the noisy input speech. The second means for capturing is configured to be positioned within a threshold distance of an ear canal of a user. The wearable device also includes means for performing an active noise cancellation (ANC) operation on the noisy input speech as captured by the first means for capturing, the noisy input speech as captured by the second means for capturing, or both, to suppress a noise level associated with the noisy input speech as captured by the second means for capturing. The wearable device further includes means for matching a second frequency spectrum of a second signal with a first frequency spectrum of a first signal. The first signal is representative of the noisy input speech as captured by the first means for capturing, and the second signal is representative of the noisy input speech as captured by the second means for capturing. The wearable device also includes means for generating an output speech signal that is representative of input speech based on the second signal having the second frequency spectrum that matches the first frequency spectrum. The wearable device further includes means for transmitting a time-domain version of the output speech signal to a mobile device.

Other implementations, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Figure 1:
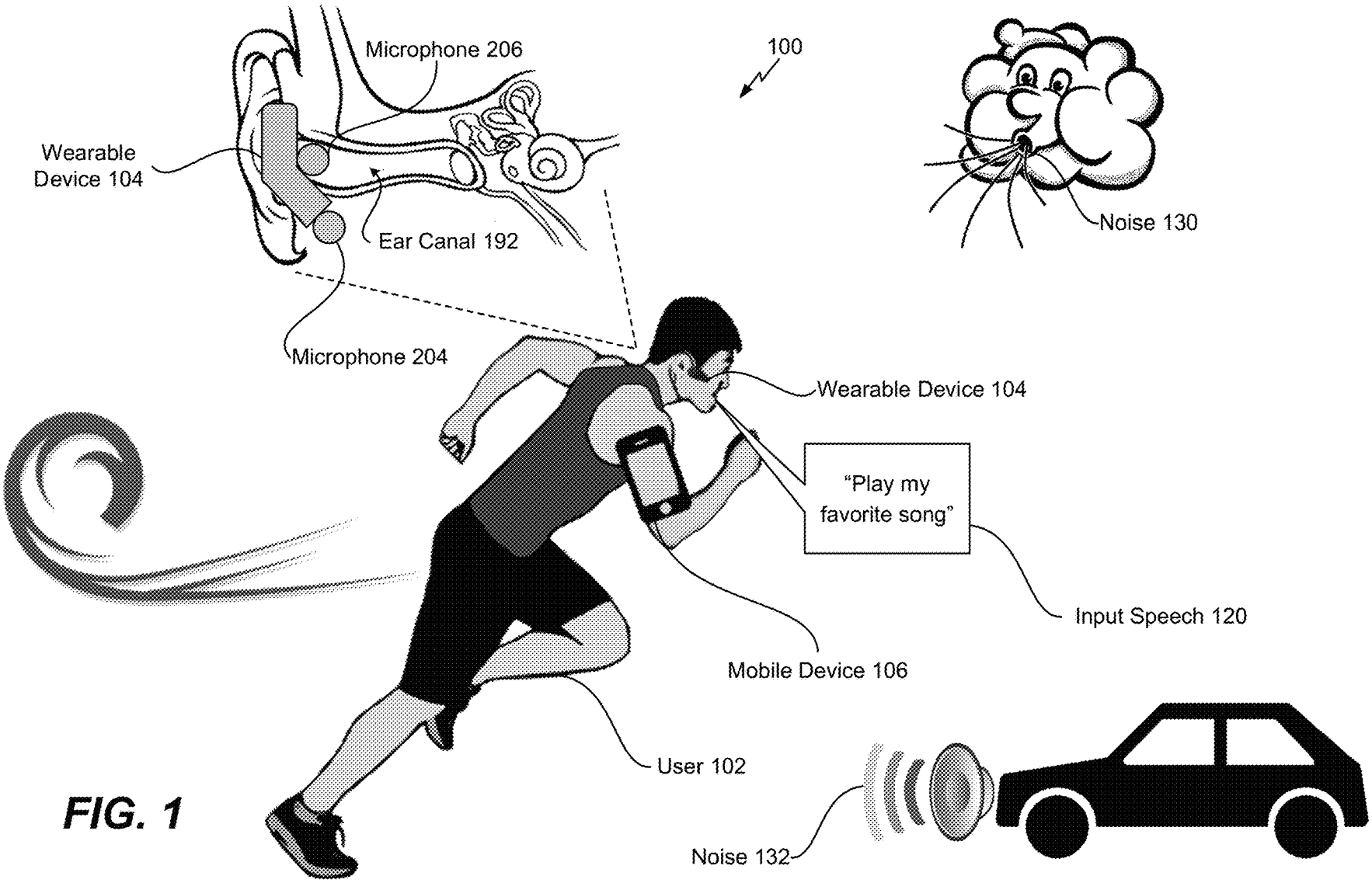
FIG. 1 depicts a scene that includes a wearable device operable to suppress noise associated with speech using an external microphone and an in-ear microphone.

Techniques described herein enable a wearable device to suppress noise captured in conjunction with input speech. For example, the wearable device includes at least one external microphone and one internal microphone (e.g., a microphone that is proximate to an ear of a user of the wearable device). As used herein, a microphone is "proximate" to an ear of a user if the microphone is within a threshold distance of the ear. As a non-limiting example, if the microphone is within five inches of the ear, the microphone is proximate to ear. To illustrate, the internal microphone can be positioned within a threshold distance of the ear such that the internal microphone captures the input speech of the user as heard through sound waves travelling from the user's ear canal. Active noise cancellation (ANC) can be performed proximate to the internal microphone to suppress the amount of noise captured by the internal microphone. For example, a feedforward ANC circuit can perform a feedforward ANC operation on the input speech as captured by the external microphone to suppress noise captured by the internal microphone. Alternatively, or in addition, a feedback ANC circuit can perform a feedback ANC operation on the input speech as captured by the internal microphone to suppress noise captured by the internal microphone. As a result, the internal microphone can capture the input speech (as heard through sound waves travelling from the user's ear canal) with relatively little noise (e.g., suppressed noise due to the ANC operations). The external microphone can also capture the input speech and any surrounding noise.

An equalizer integrated into the wearable device can match a frequency spectrum of a second audio signal associated with the input speech captured by the internal microphone with a frequency spectrum of a first audio signal associated with the input speech captured by the external microphone. As a result, audio properties of the second audio signal can be improved to offset bandwidth limitations that may otherwise be present due to capturing the corresponding input speech from sound waves propagating from the user's ear canal. The wearable device can use the second audio signal to generate an output speech signal that is representative of the user speech.

Based on the above-described noise suppression techniques, the speech quality of the user of the wearable device can be improved during a phone call or while giving a command to a voice assistant application. For example, the ANC operations can suppress the external noise leaked into an ear chamber proximate to the internal microphone. As a result, a signal-to-noise ratio of the input speech captured by internal microphone is improved.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" content (or a signal) may refer to actively generating, estimating, calculating, or determining the content (or the signal) or may refer to using, selecting, or accessing the content (or signal) that is already generated, such as by another component or device.

As used herein, "coupled" may include "communicatively coupled," "electrically coupled," or "physically coupled," and combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive electrical signals (digital signals or analog signal) directly or indirectly, such as via one or more wires, buses, networks, etc.

Referring to FIG. 1, a scene 100 that includes a wearable device operable to suppress noise associated with speech using an external microphone and an in-ear microphone is shown. In the scene 100, a user 102 is running while having a wearable device 104 attached to his ear and while having a mobile device 106 attached to his arm. As used herein, a "wearable device" can include any device that is operable to capture sounds from the user 102, illustrated as a headset in FIG. 1. Non-limiting examples of wearable device 104 can include a virtual reality headset, an augmented reality headset, a mixed reality headset, a head-mounted display, or a headset. As used herein, a "headset" includes any device that includes at least one earphone and two microphones (or other means for capturing audio). The wearable device 104 is in communication with the mobile device 106. For example, signals are transmitted between the wearable device 104 and the mobile device 106 using a communication transceiver, such as a communication transceiver 238 depicted in FIG. 2D.

In the scene 100, the user 102 talks (e.g., provides input speech 120) into the wearable device 104 to communicate with the mobile device 106. For example, the user 102 says the phrase "Play my favorite song." The wearable device 104 includes an external microphone 204 and an internal microphone 206 (e.g., an "in-ear" microphone). The external microphone 204 captures the input speech 120 via sound waves originating at the user's mouth and travelling through the air to the external microphone 204.

The internal microphone 206 captures the input speech 120 via sound waves originating at the user's vocal cords and travelling within the user's body through an ear canal 192 to the internal microphone 206. For example, the internal microphone 206 is configured to be positioned within a threshold distance of the ear canal 192 of the user 102. The threshold distance can vary based on audio parameters associated with the wearable device 104. As a non-limiting example, the threshold distance can be three centimeters. As another non-limiting example, the threshold distance can be two inches. According to one implementation, the internal microphone 206 is positioned at least partially inside the ear of the user 102, as illustrated in FIG. 1. For example, the wearable device 104 can include an "ear-insert" type of microphone and speaker. In another implementation, the internal microphone 206 is positioned within a speaker that covers the ear of the user 102. For example, the wearable device 104 can include an "ear-cup" type of microphone and speaker. In another implementation, the internal microphone 206 is positioned on the ear of the user 102. For example, the wearable device 104 can include an "on-ear" type of microphone and speaker.

The input speech 120, as captured by the external microphone 204, is subject to surrounding noise 130, 132. For example, as illustrated in FIG. 1, surrounding wind noise 130 is captured by the external microphone 204. As a result, a signal-to-noise ratio of the input speech 120, as captured by the external microphone 204, can be relatively low. Although wind noise 130 is depicted in FIG. 1, in other implementations, the input speech 120 can be subject to other noise, such as environmental noise 132 from a car horn. It should be understood that other noise can be captured by the microphones 204, 206 and that the noise suppression techniques described herein are applicable to other noise captured by the microphones 204, 206.

The input speech 120, as captured by the internal microphone 206, is substantially isolated from the noise 130, 132. However, because the input speech 120, as captured by the internal microphone 206, is based on sound waves that travel throughout the user's body, the input speech 120 is band limited between 0 Hertz (Hz) and approximately 2 kilohertz (kHz). As a result, the input speech 120, as captured by the internal microphone 206, may undergo an equalization process to adjust a balance between frequency components of the input speech 120 as captured by the internal microphone 206 and frequency components of the input speech 120 as captured by the external microphone 204.

The wearable device 104 includes circuitry, as illustrated in FIGS. 2A-4, to monitor surrounding environmental conditions. As a non-limiting example, the circuitry is configured to detect the noise 130, 132 and other noise characteristics that impact the signal-to-noise ratio of the input speech 120 as captured by the external microphone 204. Based on the surrounding environmental conditions, the circuitry is configured to determine whether to use the external microphone 204 to capture the input speech 120, whether to use the internal microphone 206 to capture the input speech 120, or whether to use both microphones 204, 206 to capture the input speech 120. As a non-limiting example, if the noise 130, 132 fails to satisfy a first noise threshold (e.g., a lower threshold), the circuitry determines to use the input speech as captured by the external microphone 204 to generate an output that is transmitted to the mobile device 106. However, if the noise 130, 132 satisfies a second noise threshold (e.g., a higher threshold), the circuitry determines to use the input speech 120 as captured by the internal microphone 206 to generate an output that is transmitted to the mobile device 106. In the scenario where the noise 130, 132 satisfies the first noise threshold and fails to satisfy the second noise threshold, the circuitry uses both microphones 204, 206 to capture the input speech 120. In this scenario, the contribution from each microphone 204, 206 is scaled based on the intensity of the noise 130, 132. As described in FIGS. 2A-2D, active noise cancellation (ANC) operations are performed on an audio signal from the internal microphone 206 to suppress noise present on the user's ear canal 192 and to improve the signal-to-noise ratio of the input speech 120 captured by the internal microphone 206.

Figure 2A:
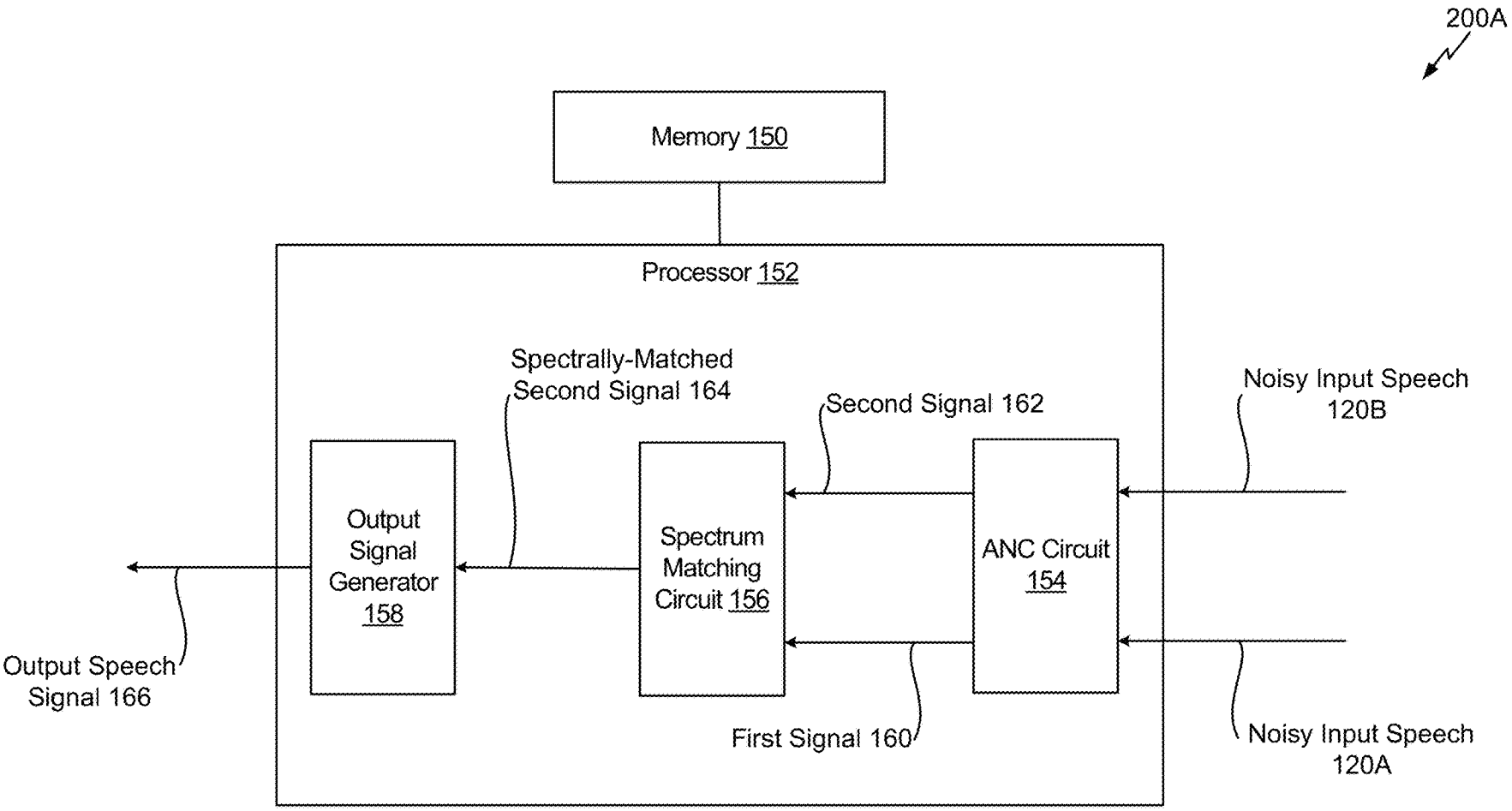
FIG. 2A depicts an illustrative example of a system that is operable to suppress noise associated with speech.

Referring to FIG. 2A, a system 200A that is operable to suppress noise associated with speech using an active noise cancellation and spectrum matching is shown. The system 200A includes one or more processors 152, collectively referred to as "processor 152." The processor 152 includes an ANC circuit 154, a spectrum matching circuit 156, and an output signal generator 158.

The ANC circuit 154 is configured to perform an ANC operation on noisy input speech 120A and noisy input speech 120B. The noisy input speech 120A corresponds to the input speech 120 as captured by the external microphone 204, and the noisy input speech 120B corresponds to the input speech 120 as captured by the internal microphone 206. The ANC circuit 154 can suppress a noise level associated with the noisy input speech 120B as captured by the internal microphone 206. The ANC circuit 154 generates a first signal 160 that is representative of the noisy input speech 120A as captured by the external microphone 204 and a second signal 162 that is representative of the noisy input speech 120B as captured by the internal microphone 206. The second signal 162 has a better signal-to-noise ratio than the noisy input speech 120B due to the ANC circuit 154, and the first signal 160 is not affected by the ANC circuit 154.

The spectrum matching circuit 156 is configured to match a second frequency spectrum of the second signal 162 with a first frequency spectrum of the first signal 160. For example, the spectrum matching circuit 156 can adjust (e.g., widen) the second frequency spectrum of the second signal 162 to generate a spectrally-matched second signal 164. The output signal generator 158 generates an output speech signal 166 that is representative of the input speech 120. For example, the output signal generator 158 can generate the output speech signal 166 based on the spectrally-matched second signal 164.

Thus, the system 200A of FIG. 2A suppresses noise from the noisy input speech 120B captured by the internal microphone 206 using the ANC circuit 154. After noise suppression is performed, spectrum matching is performed to improve a quality of the noisy input speech 120B captured by the internal microphone 206. Although FIG. 2A depicts the output speech signal 166 generated based on the spectrally-matched second signal 164, in other implementations, the output speech signal 166 can be generated based on the first signal 160, the spectrally-matched second signal 164, or a combination thereof, as described with respect to FIGS. 2B-2D.

Figure 2B:
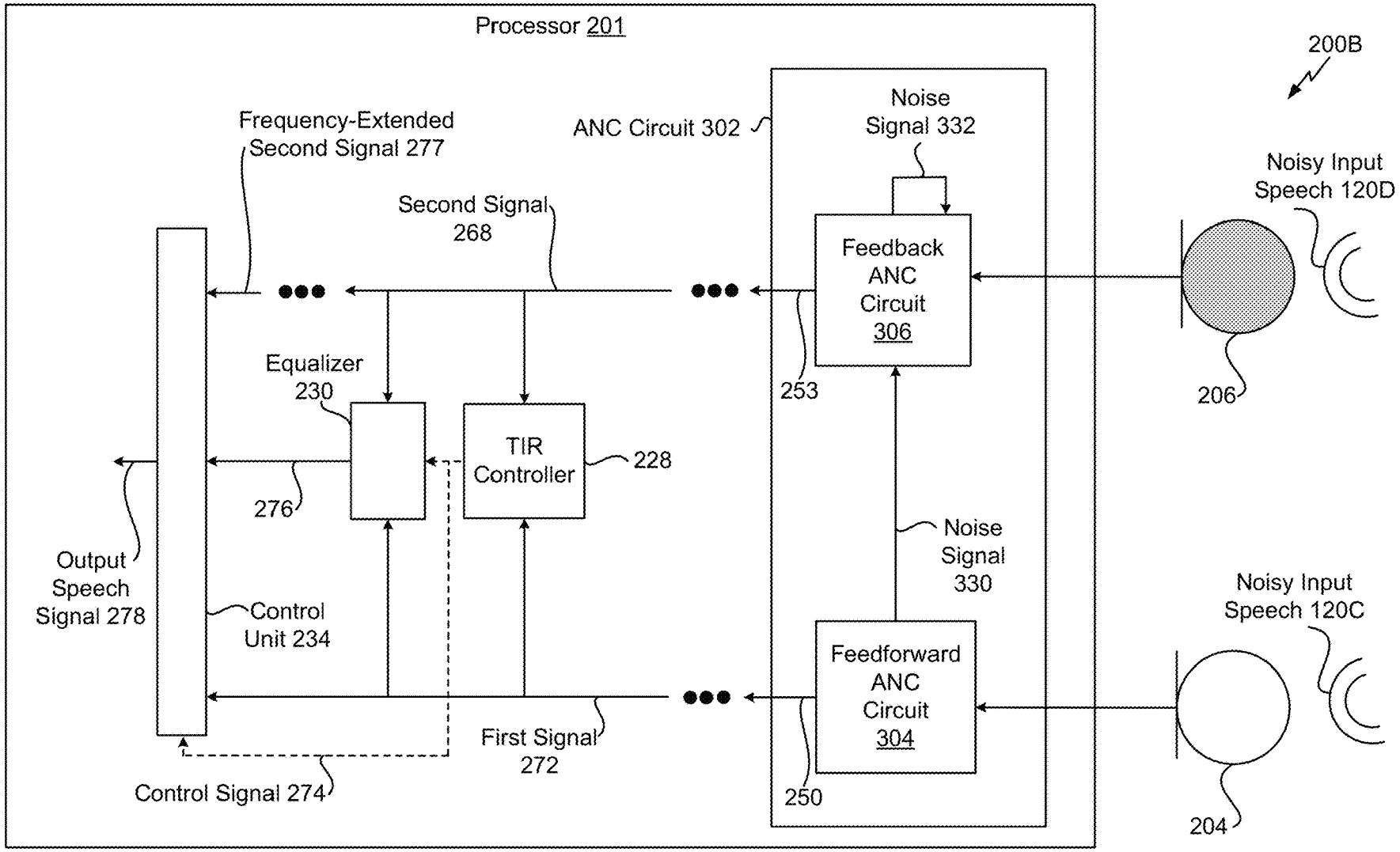
FIG. 2B depicts an illustrative example of a system that is operable to suppress noise associated with speech using an external microphone, an in-ear microphone, and active noise cancellation.

Referring to FIG. 2B, a system 200B that is operable to suppress noise associated with speech using an external microphone, an in-ear microphone, and active noise cancellation is shown. The system 200B includes one or more processors 201, collectively referred to as "processor 201." The processor 201 includes an ANC circuit 302, a target-to-interference-ratio (TIR) controller 228, an equalizer 230, and a control unit 234. The external microphone 204 (e.g., a first microphone) and the internal microphone 206 (e.g., a second microphone) are coupled to the processor 201. The ANC circuit 302 includes a feedforward ANC circuit 304 and a feedback ANC circuit 306. However, in some implementations, the ANC circuit 302 can omit one of the feedforward ANC circuit 304 or the feedback ANC circuit 306.

The external microphone 204 is configured to capture the input speech 120 and the noise 130, 132 (e.g., noisy input speech 120C). The sound captured by the external microphone 204 is provided as an audio signal to the feedforward ANC circuit 304. The feedforward ANC circuit 304 is configured to perform a feedforward ANC operation on the sound captured by the external microphone 204. To illustrate, the feedforward ANC circuit 304 can separate (e.g., filter out) the noise 130, 132 from the sound captured by the external microphone 204 to generate a noise signal 330 representative of the noise 130, 132 and to generate an input audio signal 250 representative of the noisy input speech 120C.

In the scenario where the ANC circuit 302 does not include the feedback ANC circuit 306, the feedforward ANC circuit 304 is configured to apply a phase compensation filter to the noise signal 330 to adjust a phase of the noise signal 330 by approximately one-hundred eighty (180) degrees and combine the phase-adjusted version of the noise signal 330 with the sound captured by the internal microphone 206. As a result, the noise 130, 132 captured by the internal microphone 206 is substantially canceled out (e.g., suppressed) when combined with the phase-adjusted version of the noise signal 330 to generate an input audio signal 253. However, in the illustration of FIG. 2B, the noise signal 330 is provided to the feedback ANC circuit 306.

The internal microphone 206 is configured to capture the input speech 120 and the noise 130, 132 (e.g., noisy input speech 120D). The sound captured by the internal microphone 206 is provided as an audio signal to the feedback ANC circuit 306. The feedback ANC circuit 306 is configured to perform a feedback ANC operation on the sound captured by the internal microphone 206. To illustrate, the feedback ANC circuit 306 can separate (e.g., filter out) the noise 130, 132 from the sound captured by the internal microphone 206 to generate a noise signal 332 representative of the noise 130, 132. The noise signal 332 is "fed back" into the feedback ANC circuit 306. The feedback ANC circuit 306 is configured to apply a phase compensation filter to the noise signal 332 to adjust a phase of the noise signal 332 by approximately one-hundred eighty (180) degrees and combine the phase-adjusted version of the noise signal 332 with the sound captured by the internal microphone 206. As a result, the noise 130, 132 captured by the internal microphone 206 is substantially canceled out (e.g., suppressed) when combined with the phase-adjusted version of the noise signal 332 to generate the input audio signal 253.

In the implementation of FIG. 2B where the ANC circuit 302 includes the feedback ANC circuit 306 and the feedforward ANC circuit 304, the feedback ANC circuit 306 also adjusts the phase of the noise signal 330 by approximately one-hundred eighty (180) degrees and combines the phase-adjusted version of the noise signal 330 with the sound captured by the internal microphone 206 to further reduce noise. As a result, the input audio signal 253 benefits from feedforward ANC and feedback ANC (e.g., hybrid ANC).

Figure 2C:
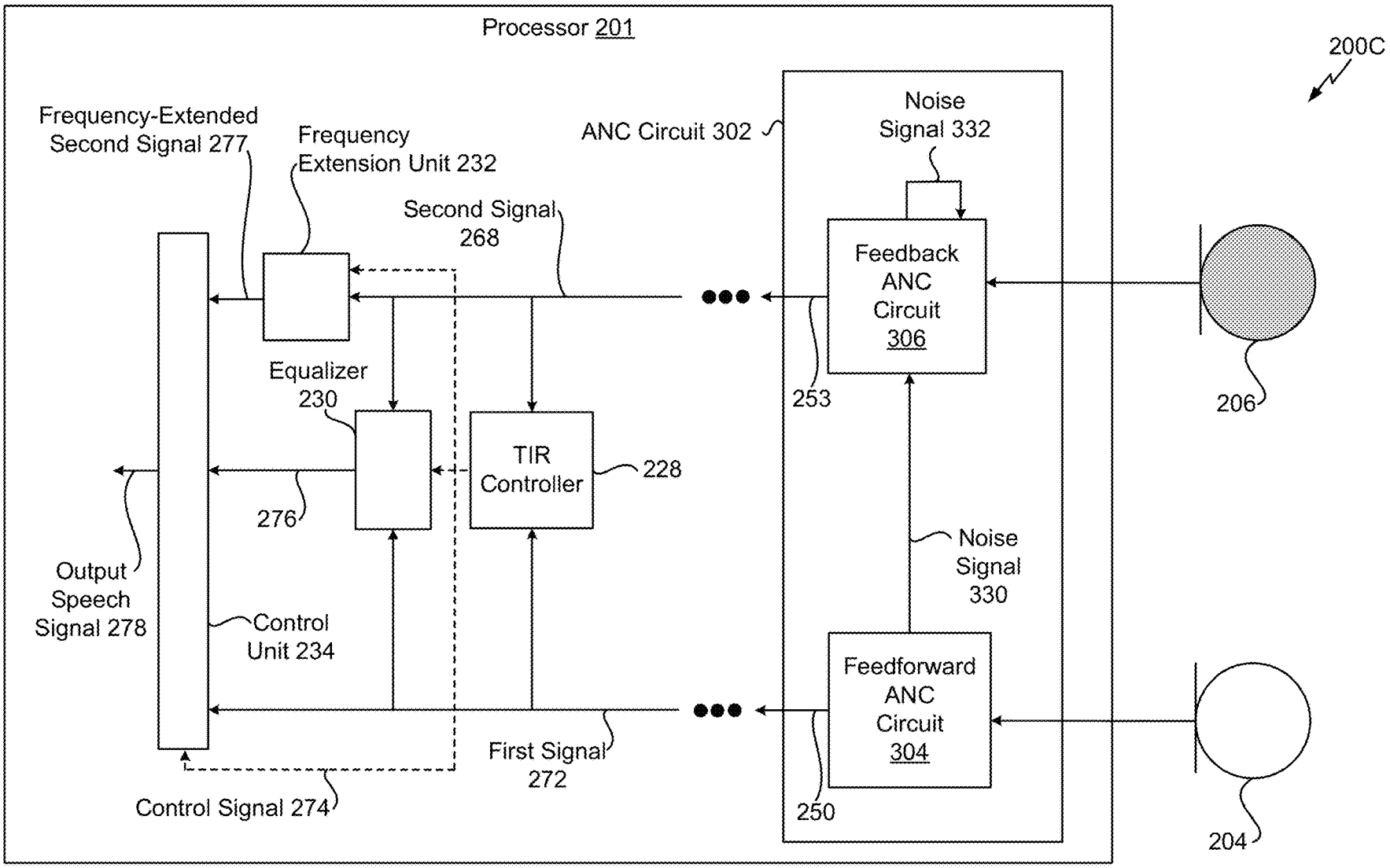
FIG. 2C depicts another illustrative example of a system that is operable to suppress noise associated with speech using an external microphone, an in-ear microphone, and active noise cancellation.
Figure 2D:
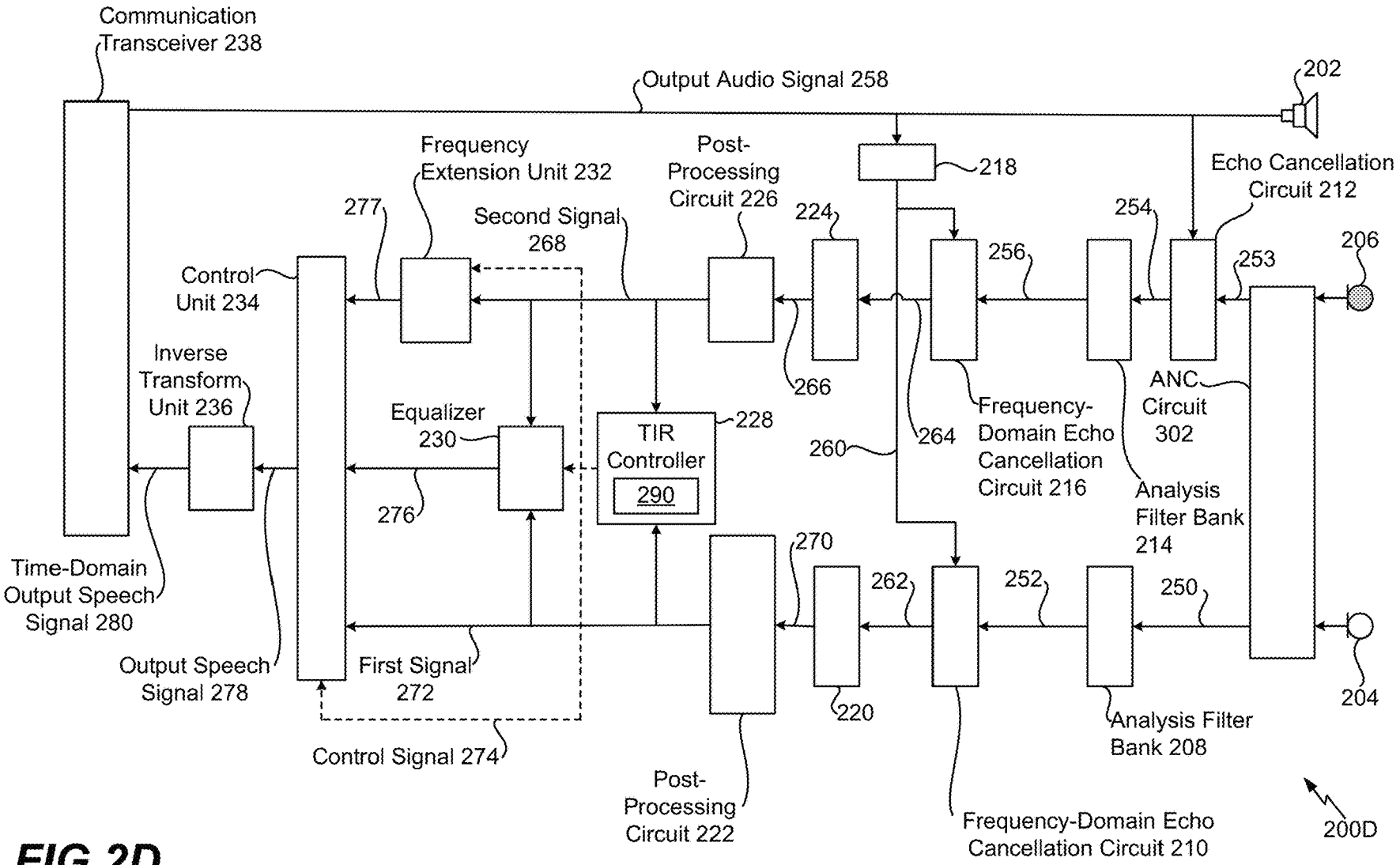
FIG. 2D depicts another illustrative example of a system that is operable to suppress noise associated with speech using an external microphone, an in-ear microphone, and active noise cancellation.

The input audio signals 250, 253 can undergo audio processing, as described with respect to FIG. 2D, such that a first signal 272 and a second signal 268 are generated, respectively. The first signal 272 is representative of the noisy input speech 120C as captured by the external microphone 204, and the second signal 268 is representative of the noisy input speech 120D as captured by the internal microphone 206. The first signal 272 is provided to the TIR controller 228, the equalizer 230, and the control unit 234. The second signal 268 is provided to the TIR controller 228 and the equalizer 230.

The TIR controller 228 can differentiate a target (e.g., the input speech 120) and any interference (e.g., any noise or other signals). As described in greater detail with respect to FIG. 2D, the TIR controller 228 can generate a control signal 274 that indicates how to use the first signal 272 and the second signal 268 in generation of an output speech signal 278 that is representative of the input speech 120 captured by the microphones 204, 206. For example, the control signal 274 can indicate whether to generate the output speech signal 278 based on the first signal 272, a frequency-extended version of the second signal 268 (e.g., a frequency-extended second signal 277), or both.

The equalizer 230 is configured to generate a signal 276 that enables the control unit 234 to match a second frequency spectrum of the second signal 268 with a first frequency spectrum of the first signal 272. For example, the equalizer 230 can perform an equalizing operation on the first signal 272 and the second signal 268 to generate the signal 276 (e.g., a spectrum matching control signal). The equalizer 230 can reduce non-stationary noise if the target speech and non-stationary interferences are uncorrelated. The signal 276 is provided to the control unit 234. The control unit 234 is configured to adjust the spectrum and the gain of at least one of the signals 272, 277 such that the signals 272, 277 matching gains. As used herein, "matching" elements are elements that are equal or approximately equal to each other, such as within five percent of each other. In a particular implementation, the equalizer 230 and the control unit 234 use a frequency-domain adaptive filter to map a speech spectrum of the internal microphone 206 to a speech spectrum of the external microphone 204. Thus, the TIR controller 228, the equalizer 230, and the control unit 234 can interoperate to perform the functionality of the spectrum matching circuit 156 of FIG. 2A. As described with respect to FIG. 2D, the control unit 234 can generate the output speech signal 278 based on control signal 274, the signal 276, the first signal 272, and frequency-extended second signal 277 and may correspond to the output signal generator 158 of FIG. 2A.

Referring to FIG. 2C, a system 200C that is operable to suppress noise associated with speech using an external microphone, an in-ear microphone, and active noise cancellation is shown. The system 200C includes the processor 201. The processor 201 includes the ANC circuit 302, the TIR controller 228, the equalizer 230, the control unit 234, and a frequency extension unit 232.

In FIG. 2C, the TIR controller 228 provides the control signal 274 to the frequency extension unit 232, and the frequency extension unit 232 is configured to perform frequency extension on the second signal 268 to generate the frequency-extended second signal 277, such that the frequency-extended second signal 277 has a wider frequency range than the second signal 268. The frequency-extended second signal 277 is provided to the control unit 234.

Referring to FIG. 2D, a system 200D that is operable to suppress noise associated with speech using an external microphone, an in-ear microphone, and active noise cancellation is shown. According to one implementation, the system 200D is integrated into a wearable device of a mobile device. As a non-limiting example, the system 200D is integrated into the wearable device 104 of the mobile device 106.

The system 200D includes a speaker 202, the external microphone 204, and the internal microphone 206. The speaker 202 is configured to playout an output audio signal 258 that is received from a communication transceiver 238, such as a BLUETOOTH® transceiver or an Institute of Electronics and Electrical Engineers (IEEE) 802.11 transceiver. BLUETOOTH® is a registered trademark assigned to BLUETOOTH SIG, INC., a Delaware corporation. The output audio signal 258 is a time-domain signal that is representative of audio received from a voice call, audio received from an interactive assistant application, or both. The speaker 202 is configured to playout the output audio signal 258 such that the user 102 of the wearable device 104 can listen to the representative audio via the speaker 202. According to one implementation, the speaker 202 is also used to playout anti-noise (generated by the ANC circuit 154) in the ear canal 192 of the user 102.

An analysis filter bank 208 is configured to perform a transform operation on the input audio signal 250 to generate a frequency-domain input audio signal 252. For example, the analysis filter bank 208 is configured to convert the input audio signal 250 from a time-domain signal to a frequency-domain signal. The transform operation can include a Discrete Cosine Transform (DCT) operation, a Fast Fourier Transform (FFT) operation, etc. The frequency-domain input audio signal 252 is provided to a frequency-domain echo cancellation circuit 210.

A full-band echo cancellation circuit 212 is configured to perform acoustic echo cancellation on the input audio signal 253 to generate an input audio signal 254. The input audio signal 254 is provided to an analysis filter bank 214. The analysis filter bank 214 is configured to perform a transform operation on the input audio signal 254 to generate a frequency-domain input audio signal 256. For example, the analysis filter bank 214 is configured to convert the input audio signal 254 from a time-domain signal to a frequency-domain signal. The transform operation can include a DCT operation, a FFT operation, etc. The frequency-domain input audio signal 256 is provided to a frequency-domain echo cancellation circuit 216.

An analysis filter bank 218 is configured to perform a transform operation on the output audio signal 258 to generate a frequency-domain output audio signal 260. For example, the analysis filter bank 218 is configured to convert the output audio signal 258 from a time-domain signal to a frequency-domain signal. The transform operation can include a DCT operation, a FFT operation, etc. The frequency-domain output audio signal 260 is provided to the frequency-domain echo cancellation circuit 210 and to the frequency-domain echo cancellation circuit 216.

The frequency-domain echo cancellation circuit 210 is configured to perform frequency-domain echo cancellation on the frequency-domain input audio signal 252 to generate a frequency-domain input audio signal 262. For example, the frequency-domain echo cancellation circuit 210 can substantially reduce the amount of echo present in the frequency-domain input audio signal 252. According to one implementation, the frequency-domain echo cancellation circuit 210 uses reverberation characteristics of the frequency-domain output audio signal 260 to reduce (e.g., cancel) the echo in the frequency-domain input audio signal 252. The frequency-domain input audio signal 262 is provided to a single microphone noise reduction unit 220. The frequency-domain echo cancellation circuit 216 is configured to perform frequency-domain echo cancellation on the frequency-domain input audio signal 256 to generate a frequency-domain input audio signal 264. For example, the frequency-domain echo cancellation circuit 216 can substantially reduce the amount of echo present in the frequency-domain input audio signal 256. According to one implementation, the frequency-domain echo cancellation circuit 216 uses reverberation characteristics of the frequency-domain output audio signal 260 to reduce (e.g., cancel) the echo in the frequency-domain input audio signal 256. The frequency-domain input audio signal 264 is provided to a single microphone noise reduction unit 224.

The single microphone noise reduction unit 220 is configured to perform noise reduction on the frequency-domain input audio signal 262 to generate a frequency-domain signal 270. For example, the single microphone noise reduction unit 220 is configured to remove stationary noise from the frequency-domain input audio signal 262. The frequency-domain signal 270 is provided to a post-processing circuit 222. The single microphone noise reduction unit 224 is configured to perform noise reduction on the frequency-domain input audio signal 264 to generate a frequency-domain signal 266. For example, the single microphone noise reduction unit 224 is configured to remove stationary noise from the frequency-domain input audio signal 264. The frequency-domain signal 266 is provided to a post-processing circuit 226.

The post-processing circuit 222 is configured to perform post-processing operations on the frequency-domain signal 270 to generate the first signal 272, and the post-processing circuit 226 is configured to perform post-processing operations on the frequency-domain signal 266 to generate the second signal 268. The post-processing operations can include additional echo cancellation processing, noise reduction processing, etc. The first signal 272 is representative of the noisy input speech 120C as captured by the microphone 204, and the second signal 268 is representative of the noisy input speech 120D as captured by the microphone 206. The first signal 272 is provided to the TIR controller 228, the equalizer 230, and the control unit 234. The second signal 268 is provided to the TIR controller 228, the equalizer 230, and the frequency extension unit 232.

The TIR controller 228 is configured to receive the first signal 272 and the second signal 268. The TIR controller 228 can differentiate a target (e.g., the input speech 120) and any interference (e.g., any noise or other signals). For example, the TIR controller 228 is configured to determine a noise characteristic 290 associated with the first signal 272. For example, the noise characteristic 290 can include a signal-to-noise ratio associated with the first signal 272, a speech intelligibility level associated with the first signal 272, a noise level of the surrounding noise 130, 132, etc. The speech intelligibility level corresponds to a percentage of intelligible words in speech associated with the first signal 272. Based on the noise characteristic 290, the TIR controller 228 is configured to generate the control signal 274 that indicates how to use the first signal 272 and the second signal 268 in generation of the output speech signal 278 that is representative of the input speech 120 captured by the microphones 204, 206. The control signal 274 is provided to the equalizer 230, the frequency extension unit 232, and the control unit 234.

The control signal 274 indicates how to adjust a frequency range of the second signal 268. For example, the TIR controller 228 is configured to determine the frequency range of the second signal 268. Because the second signal 268 is generated based on the noisy input speech 120D captured through the user's ear canal 192, the second signal 268 has a relatively low frequency range. As a non-limiting example, the frequency range of the second signal 268 is between 0 Hz and 2.5 kHz. As a result, the TIR controller 228 is configured to generate the control signal 274 such that the control signal 274 indicates how to extend (e.g., widen) the frequency range of the second signal 268 such that the second signal 268 covers a wider frequency range, such as 0 Hz to 20 kHz. To illustrate, the TIR controller 228 provides the control signal 274 to the frequency extension unit 232, and the frequency extension unit 232 is configured to perform frequency extension on the second signal 268 to generate the frequency-extended second signal 277, such that the frequency-extended second signal 277 has a wider frequency range than the second signal 268. The frequency-extended second signal 277 is provided to the control unit 234.

The TIR controller 228 is configured to compare the noise characteristic 290 to one or more noise thresholds. For example, the TIR controller 228 is configured to compare the noise characteristic 290 to a first noise threshold (e.g., a lower noise threshold), a second noise threshold (e.g., a higher noise threshold), or both. If the TIR controller 228 determines that the noise characteristic 290 fails to satisfy (e.g., is lower than) the first noise threshold, the control signal 274 indicates to generate the output speech signal 278 based on the first signal 272. For example, in scenarios where the input speech 120 captured by the microphone 204 is relatively noise-free input speech, the output speech signal 278 matches the first signal 272.

If the TIR controller 228 determines that the noise characteristic 290 satisfies (e.g., is higher than) the second noise threshold, the control signal 274 indicates to generate the output speech signal 278 based on the frequency-extended second signal 277. For example, in scenarios where the input speech 120 captured by the microphone 204 has a high degree of noise, the output speech signal 278 is generated based on the input speech 120 as detected by the microphone 206 (e.g., the internal microphone that captures the input speech 120 through the user's ear canal 192).

If the TIR controller 228 determines that the noise characteristic 290 satisfies the first noise threshold and fails to satisfy the second noise threshold, the control signal 274 indicates to generate the output speech signal 278 based on the first signal 272 and the frequency-extended second signal 277. According to one implementation, the signals 272, 277 are equalized, scaled, and combined to generate the output speech signal 278. For example, the equalizer 230 is configured to perform an equalizing operation on the first signal 272 and the second signal 268 to generate the signal 276 (e.g., a spectrum matching control signal). The equalizer 230 can reduce non-stationary noise if the target speech and non-stationary interferences are uncorrelated. The signal 276 is provided to the control unit 234. The control unit 234 is configured to adjust the spectrum and the gain of at least one of the signals 272, 277 such that the signals 272, 277 have approximately equal (e.g., matching) gains. For example, the control unit 234 can adjust the spectrum and the gain of one or more of the signals 272, 277 such that the gains of the signals 272, 272 are within five percent of each other. The equalizer 230 and the control unit 234 use a frequency-domain adaptive filter to map a noise spectrum of the internal microphone 206 to a noise spectrum of the external microphone 204. To illustrate, based on the signal 276, the control unit 234 is configured to match the second frequency spectrum of the second signal 268 (or the frequency-extended second signal 277) with the first frequency spectrum of the first signal 272.

As described above, the control signal 274 is generated based on comparing the noise characteristic 290 to one or more thresholds. However, in other implementations, the control signal 274 can be generated based on the noise characteristic 290 and neural network data. For example, the TIR controller 228 can apply the noise characteristic 290 to a neural network generated by a machine learning algorithm to generate the control signal 274.

Additionally, the control signal 274 indicates how to scale the first signal 272 and the frequency-extended second signal 277. For example, based on the noise characteristic 290, the control signal 274 indicates a first scaling factor for the first signal 272 and a second scaling factor for the frequency-extended second signal 277. To illustrate, if the noise characteristic 290 indicates the first signal 272 has a relatively high degree of noise, the second scaling factor is larger than the first scaling factor. If the noise characteristic 290 indicates the first signal 272 has a relatively low degree of noise, the first scaling factor is larger than the second scaling factor. The control unit 234 is configured to scale the first signal 272 by the first scaling factor to generate a first portion of the output speech signal 278, scale the frequency-extended second signal 277 by the second scaling factor to generate a second portion of the output speech signal 278, and combine the first portion of the output speech signal 278 and the second portion of the output speech signal 278 to generate the output speech signal 278.

The output speech signal 278 is provided to an inverse transform unit 236. The inverse transform unit 236 is configured to perform an inverse transform operation on the output speech signal 278 to generate a time-domain output speech signal 280. The inverse transform operation can include an Inverse Discrete Cosine Transform (IDCT) operation, an Inverse Fast Fourier Transform (IFFT) operation, etc. The time-domain output speech signal 280 is provided to the communication transceiver 238. The communication transceiver 238 can send the time-domain output speech signal 280 to the interactive assistant application, to a mobile phone transceiver for voice call communication, etc.

The system 200A-200D of FIG. 2A-2D improves existing echo cancellation and noise suppression techniques by using the TIR controller 228 to determine how the microphones 204, 206 are used based on the environmental conditions. For example, if there is a relatively low degree of surrounding noise 130, 132 (e.g., wind noise 130, environmental noise 132, or other noise resulting in a low signal-to-noise ratio for sound captured by the external microphone 204), the TIR controller 228 can determine to use the input speech 120 captured by the external microphone 204 to generate the output speech signal 278. Alternatively, if there is a relatively high degree of surrounding noise 130, 132, the TIR controller 228 can determine to use the input speech 120 captured by the internal microphone 206 to generate the output speech signal 278. Because the input speech 120 (e.g., the hearable user voice) captured by the internal microphone 206 is isolated from wind and environmental noise 130, in this scenario, the output speech signal 278 can have a substantially higher signal-to-noise ratio. Thus, the TIR controller 228 and the control unit 234 can monitor environmental conditions and select microphone combinations and post-processing (e.g., scaling) combinations that are suitable for the environmental conditions to generate a high-quality output speech signal 278.

The systems 200A-200D also suppress noise at the internal microphone 206 by utilizing hybrid ANC technology. Although hybrid ANC technology is illustrated in FIGS. 2A-2D, in other implementations, ANC feedforward technology or ANC feedback technology can be utilized independently. For example, in one implementation, the feedforward ANC circuit 304 can be used to suppress noise at the internal microphone 206 without the feedback ANC circuit 306. In another implementation, the feedback ANC circuit 306 can be used to suppress noise at the internal microphone 206 without the feedforward ANC circuit 304.

Figure 3:
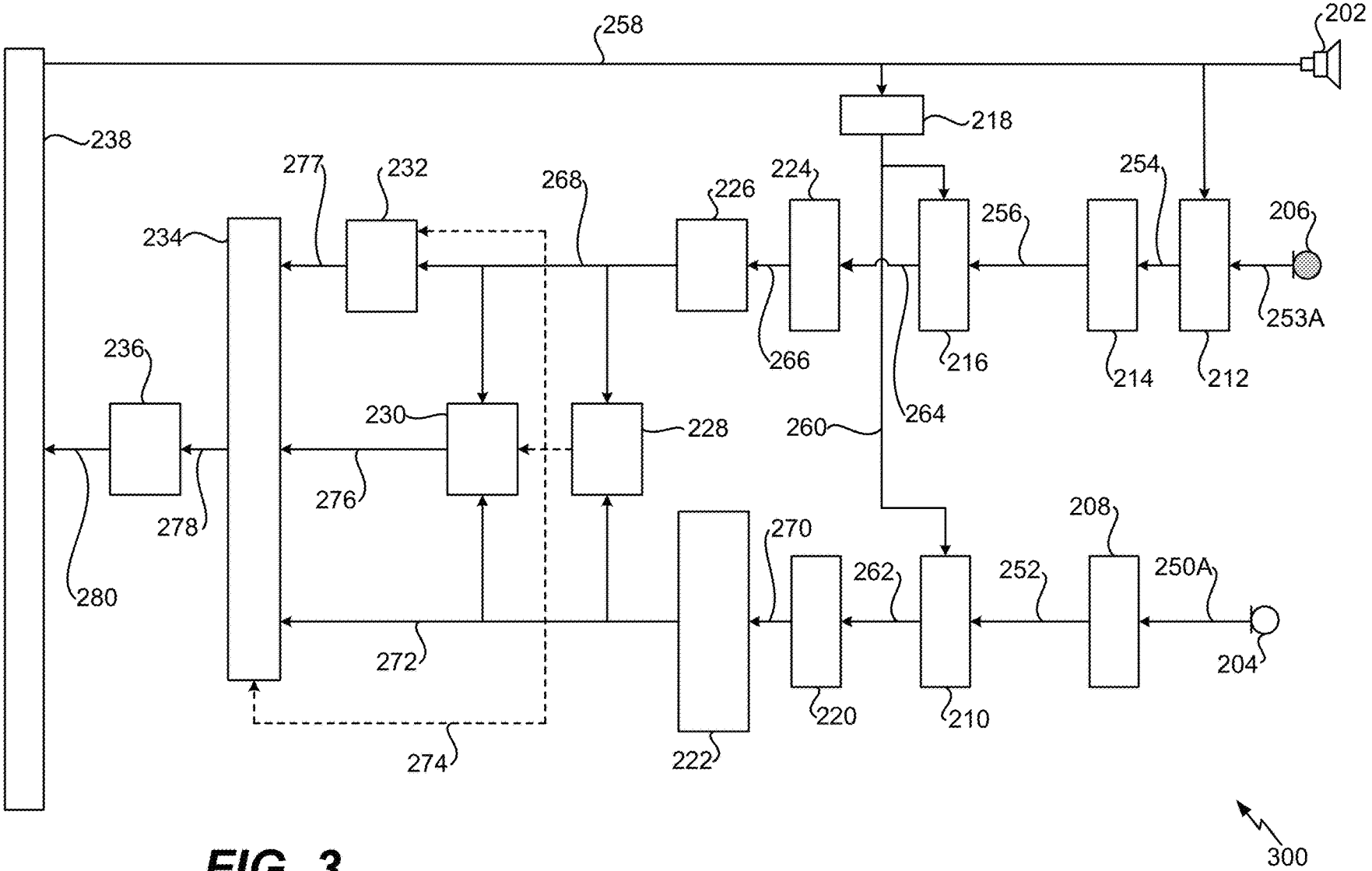
FIG. 3 depicts an illustrative example of a system that is operable to suppress noise associated with speech using an external microphone and an in-ear microphone.

Referring to FIG. 3, a system 300 that is operable to suppress noise associated with speech using an external microphone and an in-ear microphone is shown. According to one implementation, the system 300 is integrated into a wearable device, such as the wearable device 104 of FIG. 1.

The system 300 operates in a substantially similar manner as the systems 200A-200D of FIGS. 2A-2D. However, the system 300 does not include active noise cancellation. To illustrate, the external microphone 204 captures the input speech 120 and the noise 130, 132 and generates an input audio signal 250A that is provided to the analysis filter bank 208. In a similar manner, the internal microphone 206 captures the input speech 120 and the noise 130, 132 and generates an input audio signal 253A that is provided to the echo cancellation circuit 212. Thus, ANC is bypassed in generation of the input audio signals 250A, 253A. As a result, the system 300 is more cost efficient and occupies less die area than the systems 200A-200D.

Figure 4:
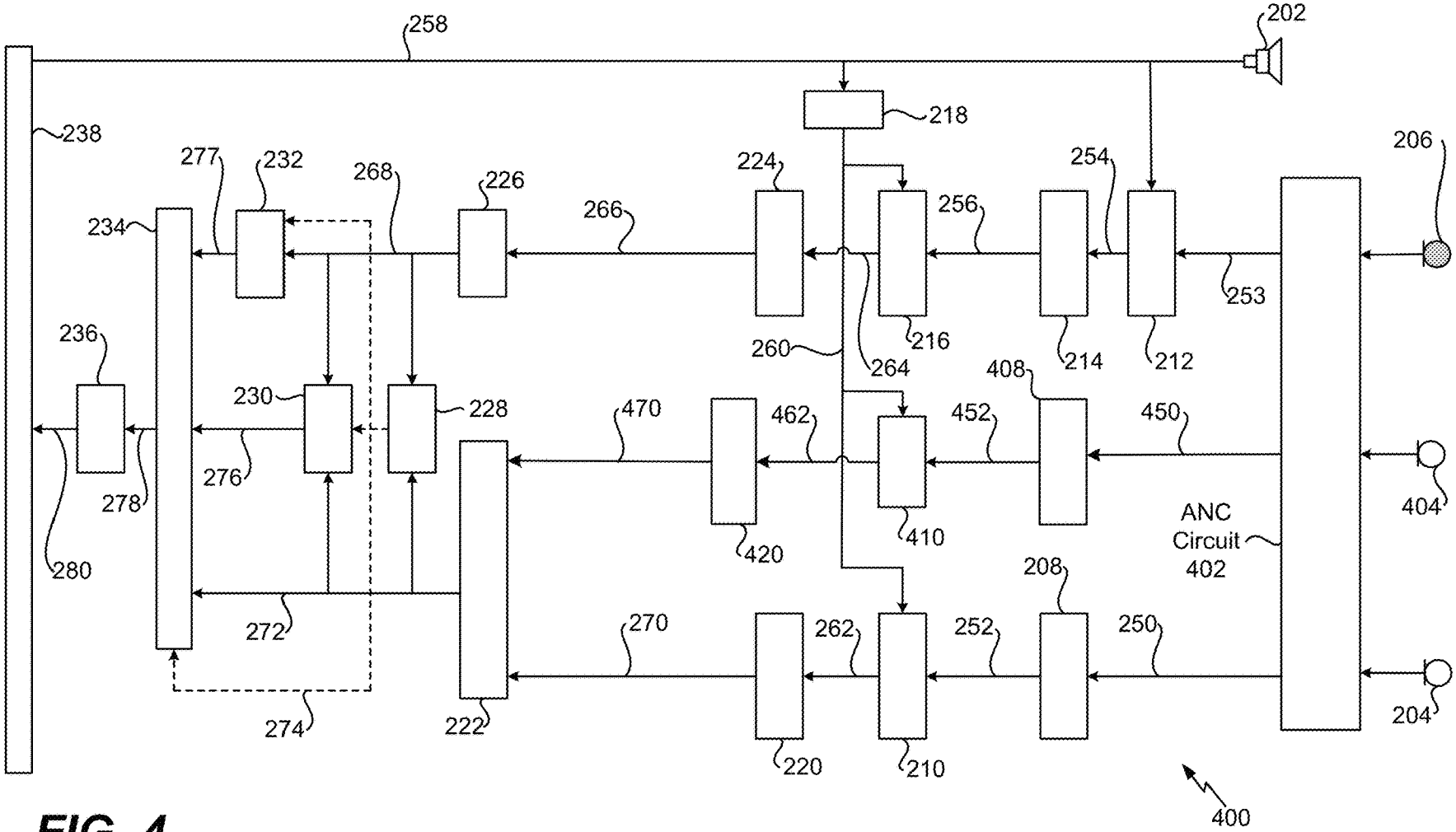
FIG. 4 depicts an illustrative example of a system that is operable to suppress noise associated with speech using multiple external microphones, an in-ear microphone, and active noise cancellation.

Referring to FIG. 4, a system 400 that is operable to suppress noise associated with speech using multiple external microphones, an in-ear microphone, and active noise cancellation is shown. According to one implementation, the system 400 is integrated into a wearable device, such as the wearable device 104 of FIG. 1. The system 400 operates in a substantially similar manner as the systems 200A-300 of FIGS. 2A-3. However, the system 400 multiple includes external microphones.

For example, the system 400 includes a second external microphone 404 that is configured to capture the input speech 120 and the noise 130, 132. The microphone 404 is located proximate to a mouth of the user 102 and is configured to capture the input speech 120 spoken by the user 102 and the surrounding noise 130, 132. The input speech 120 spoken by the user 102 and the surrounding noise 130, 132 captured by the microphone 404 are provided to an ANC circuit 402. The ANC circuit 402 operates in a substantially similar manner as the ANC circuit 302; however, the ANC circuit 402 includes a second feedforward ANC circuit (not shown) coupled to the second external microphone 404. The ANC circuit 402 generates an input audio signal 450. The input audio signal 450 is a time-domain signal that is representative of sounds captured (e.g., detected) by the microphone 404. The input audio signal 450 is provided to an analysis filter bank 408.

The analysis filter bank 408 is configured to perform a transform operation on the input audio signal 450 to generate a frequency-domain input audio signal 452. For example, the analysis filter bank 408 is configured to convert the input audio signal 450 from a time-domain signal to a frequency-domain signal. The transform operation can include a DCT operation, an FFT operation, etc. The frequency-domain input audio signal 452 is provided to a frequency-domain echo cancellation circuit 410.

The frequency-domain echo cancellation circuit 410 is configured to perform frequency-domain echo cancellation on the frequency-domain input audio signal 452 to generate a frequency-domain input audio signal 462. For example, the frequency-domain echo cancellation circuit 410 is configured to substantially reduce the amount of echo present in the frequency-domain input audio signal 452. According to one implementation, the frequency-domain echo cancellation circuit 410 uses reverberation characteristics of the frequency-domain output audio signal 260 to reduce (e.g., cancel) the echo in the frequency-domain input audio signal 452. The frequency-domain input audio signal 462 is provided to a single microphone noise reduction unit 420.

The single microphone noise reduction unit 420 is configured to perform noise reduction on the frequency-domain input audio signal 462 to generate a frequency-domain signal 470. For example, the single microphone noise reduction unit 420 is configured to remove stationary noise from the frequency-domain input audio signal 462. The frequency-domain signal 470 is provided to the post-processing circuit 222. In FIG. 4, the post-processing circuit 222 is configured to perform post-processing operations on the frequency-domain signal 270 and the frequency-domain signal 470 to generate the first signal 272. Thus, in FIG. 4, the first signal 272 is representative of the input speech 120 as captured by both external microphones 204, 404.

Thus, the system 400 of FIG. 4 utilizes multiple external microphones to improve capture of the input speech 120 and suppresses noise at the internal microphone 206 by utilizing hybrid ANC technology. Although hybrid ANC technology is illustrated in FIG. 4, in other implementations, ANC feedforward technology or ANC feedback technology can be utilized independently.

Figure 5:
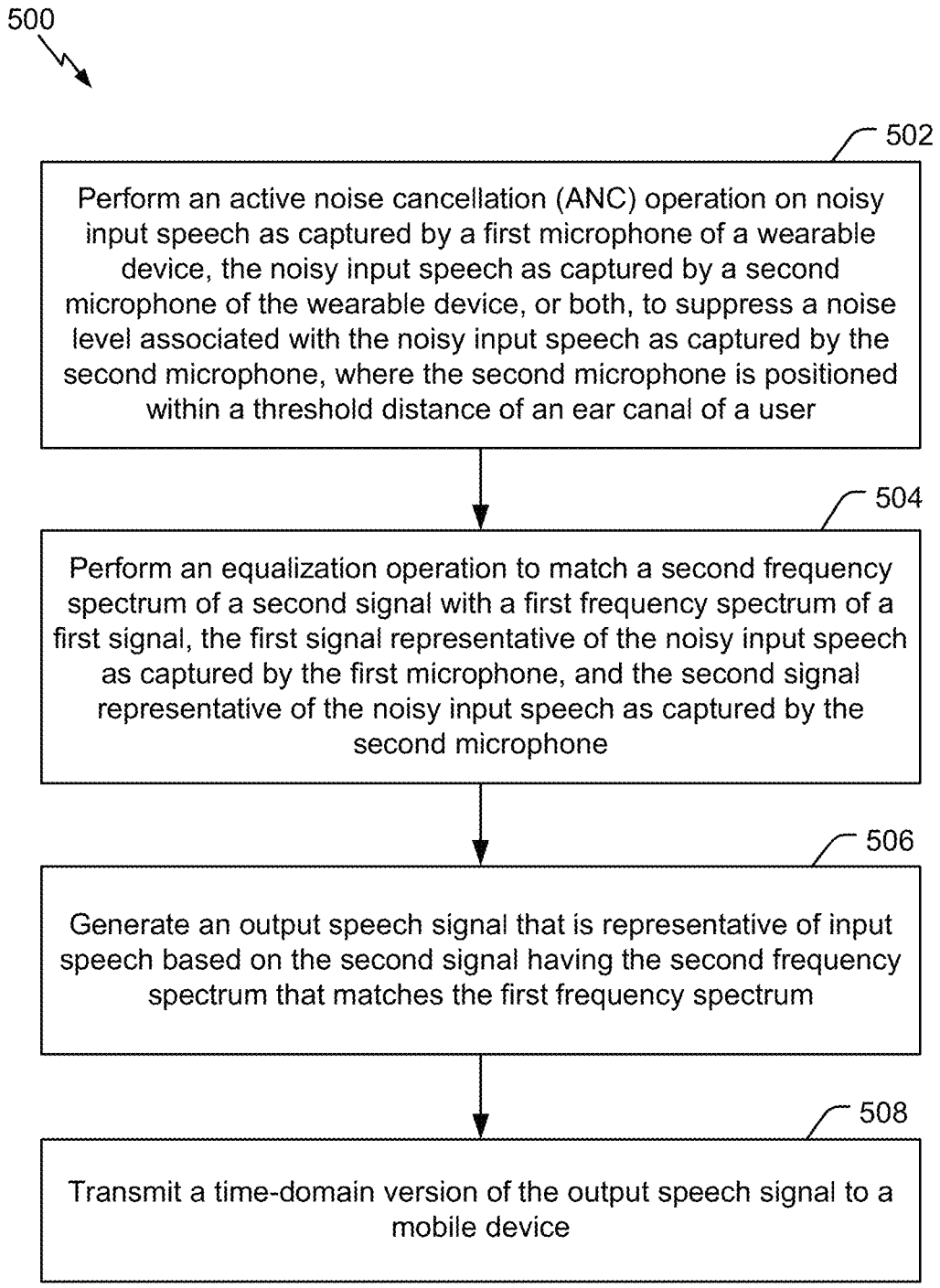
FIG. 5 is an illustrative example of a flowchart of a method for suppressing noise associated with speech using an external microphone and an in-ear microphone.

Referring to FIG. 5, a flowchart of a method 500 for suppressing noise associated with speech using an external microphone and an in-ear microphone is shown. The method 500 can be performed by the wearable device 104 of FIG. 1, the systems of FIG. 2A-2D, the system 300 of FIG. 3, the system 400 of FIG. 4, or a combination thereof.

The method 500 includes performing an ANC operation on noisy input speech as captured by a first microphone of a wearable device, the noisy input speech as captured by a second microphone of the wearable device, or both, to suppress a noise level associated with the noisy input speech as captured by the second microphone, at 502. The second microphone is positioned within a threshold distance of an ear canal of a user. For example, referring to FIG. 2B, the feedforward ANC circuit 304 performs the feedforward ANC operation on the noisy input speech 120C as captured by the external microphone 204 and the feedback ANC circuit 306 perform the feedback ANC operation on the noisy input speech 120D as captured by the internal microphone 206.

The method 500 also includes performing an equalization operation to match a second frequency spectrum of a second signal with a first frequency spectrum of a first signal, at 504. The first signal is representative of the noisy input speech as captured by the first microphone, and the second signal is representative of the noisy input speech as captured by the second microphone. For example, referring to FIG. 2B, the equalizer 230 and the control unit 234 perform the equalization operation to match the second frequency spectrum of the second signal 268 (or the frequency-extended second signal 277) with the first frequency spectrum of the first signal 272.

The method 500 also includes generating an output speech signal that is representative of input speech based on the second signal having the second frequency spectrum that matches the first frequency spectrum, at 506. For example, referring to FIG. 2B, the control unit 234 generates the output speech signal 278 that is representative of the input speech 120 based on the second signal 268 (or the frequency-extended second signal 277).

The method 500 also includes transmitting a time-domain version of the output speech signal to a mobile device, at 508. For example, referring to FIG. 2D, the communication transceiver 238 transmits the time-domain output speech signal 280 to the mobile device 106.

According to one implementation, the method 500 also includes determining a noise characteristic associated with the input speech as captured by the first microphone. For example, referring to FIG. 2D, the TIR controller 228 determines the noise characteristic 290 associated with the first signal 272. The noise characteristic 290 can include the signal-to-noise ratio associated with the first signal 272, the speech intelligibility level associated with the first signal 272, etc. According to one implementation, the noise characteristic 290 can include a signal-to-noise ratio of the input audio signal 250 as captured by the external microphone 204.

According to one implementation, the method 500 also includes generating a control signal based on the noise characteristic. The control signal indicates how to use the first signal and the second signal in generation of the output speech signal. For example, referring to FIG. 2D, based on the noise characteristic 290, the TIR controller 228 generates the control signal 274 that indicates how to use the first signal 272 and the second signal 268 in generation of the output speech signal 278. To illustrate, according to one implementation, the method 500 can include determining that the noise characteristic 290 fails to satisfy a lower noise threshold. The control signal 274 indicates, to the control unit 234, to generate the output speech signal 278 based on the first signal 272 in response to determining that the noise characteristic 290 fails to satisfy the lower noise threshold. According to another implementation, the method 500 can include determining that the noise characteristic 290 satisfies an upper noise threshold. The control signal 274 indicates, to the control unit 234, to bypass uses of the first signal 272 in generation of the output speech signal 278 and to generate the output speech signal 278 based on the second signal 268 (or the frequency-extended second signal 277) in response to determining that the noise characteristic 290 satisfies the upper noise threshold.

According to another implementation, the method 500 can include determining that the noise characteristic 290 satisfies the lower noise threshold and fails to satisfy the upper noise threshold. The control signal 274 indicates, to the control unit 234, to generate the output speech signal 278 based on the first signal 272 and the second signal 268 (or the frequency-extended second signal 277) in response to determining that the noise characteristic 290 satisfies the lower noise threshold and fails to satisfy the upper noise threshold. In this scenario, the method 500 can include scaling the first signal 272 by the first scaling factor to generate the first portion of the output speech signal 278 and scaling the frequency-extended second signal 277 by the second scaling factor to generate the second portion of the output speech signal 278. The first scaling factor and the second scaling factor are based on the noise characteristic 290. The method 500 can also include combining the first portion of the output speech signal 278 and the second portion of the output speech signal 278 to generate the output speech signal 278.

According to one implementation, the method 500 includes determining a frequency range of the second signal 268 and performing, based on the frequency range, frequency extension on the second signal 268 to generate the frequency-extended second signal 277. According to one implementation, the method 500 includes performing the equalizing operation on the first signal 272 and the second signal 268. According to one implementation, the method 500 includes performing the inverse transform operation on the output speech signal 278 to generate the time-domain output speech signal 280 that is provided to the communication transceiver 238.

According to one implementation, the method 500 includes performing the feedforward ANC operation on the input speech 120 as captured by the microphone 204. The method 500 can also include performing the feedback ANC operation on the input speech 120 as captured by the microphone 206. The second signal 268 can be based on the feedforward ANC operation and the feedback ANC operation.

The method 500 of FIG. 5 improves existing echo cancellation and noise suppression techniques by determining how the audio signals from the microphones 204, 206 are used based on the environmental conditions. For example, if there is a relatively low degree of surrounding noise 130, 132, the processor 201 can determine to use the input speech 120 captured by the external microphone 204 to generate the output speech signal 278. Alternatively, if there is a relatively high degree of surrounding noise 130, 132, the processor 201 can determine to use the input speech 120 captured by the internal microphone 206 to generate the output speech signal 278. Because the input speech 120 (e.g., the hearable user voice) captured by the internal microphone 206 is isolated from wind and environmental noise 130, 132, in this scenario, the output speech signal 278 can have a substantially higher signal-to-noise ratio. Thus, the processor 201 can monitor environmental conditions and select microphone combinations and post-processing (e.g., scaling) combinations that are suitable for the environmental conditions to generate a high-quality output speech signal 278. The method 500 also suppresses noise at the internal microphone 206 by utilizing hybrid ANC technology.

Figure 6A:
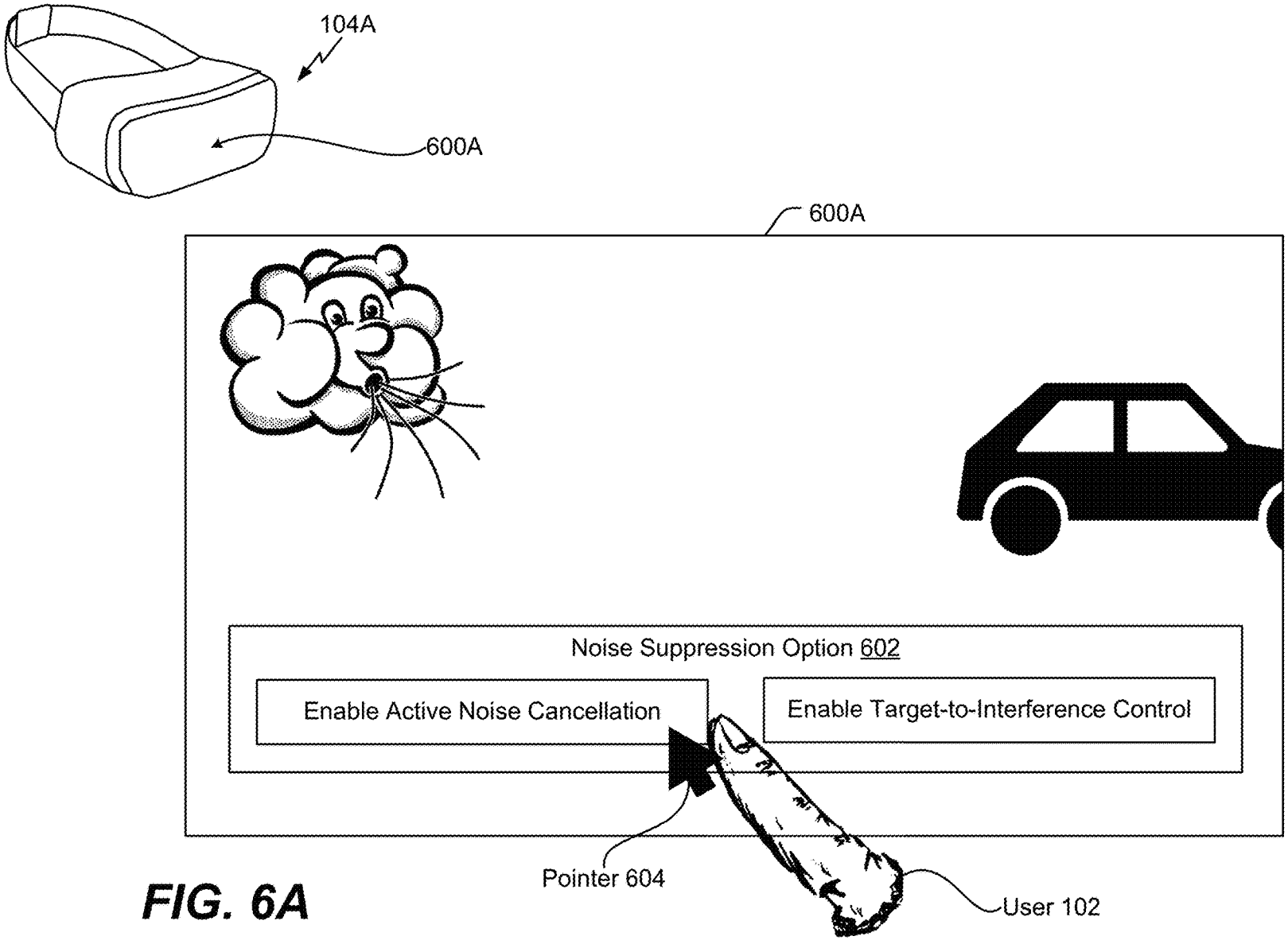
FIG. 6A is an illustrative example of a graphical user interface that enables a user to control operation of a wearable device that is operable to perform the techniques described with reference to FIGS. 1-5.

FIG. 6A is an illustrative example of a graphical user interface 600A that enables a user to control operation of a wearable device. For example, the graphical user interface 600A can be integrated into the wearable device 104. As illustrated in FIG. 6A, the graphical user interface 600A can be integrated into a screen of a wearable device 104A. In the illustrated example of FIG. 6A, the wearable device 104A can be a virtual reality headset, an augmented reality headset, or a mixed reality headset.

The graphical user interface 600A includes a noise suppression option 602 that is visible to the user 102. The user 102 can use his or her finger to control a pointer 604 of the graphical user interface 600A. The pointer 604 is used to select one or more noise suppression options 602. For example, the user 102 can use his or her finger to enable active noise cancellation, to enable target-to-interference control, or to enable both. To illustrate, if the user 102 guides the pointer 604 to enable active noise cancellation, the ANC circuit 302 can perform the ANC operations to suppress noise at the internal microphone 206. If the user 102 guides the pointer 604 to enable target-to-interference control, the TIR controller 228 can determine the noise characteristic 290. Based on the noise characteristic, the TIR controller 228 can generate the control signal 274 that indicates how to use the first signal 272 and the second signal 268 in generation of the output speech signal 280, as described with respect to FIG. 2D.

Figure 7:
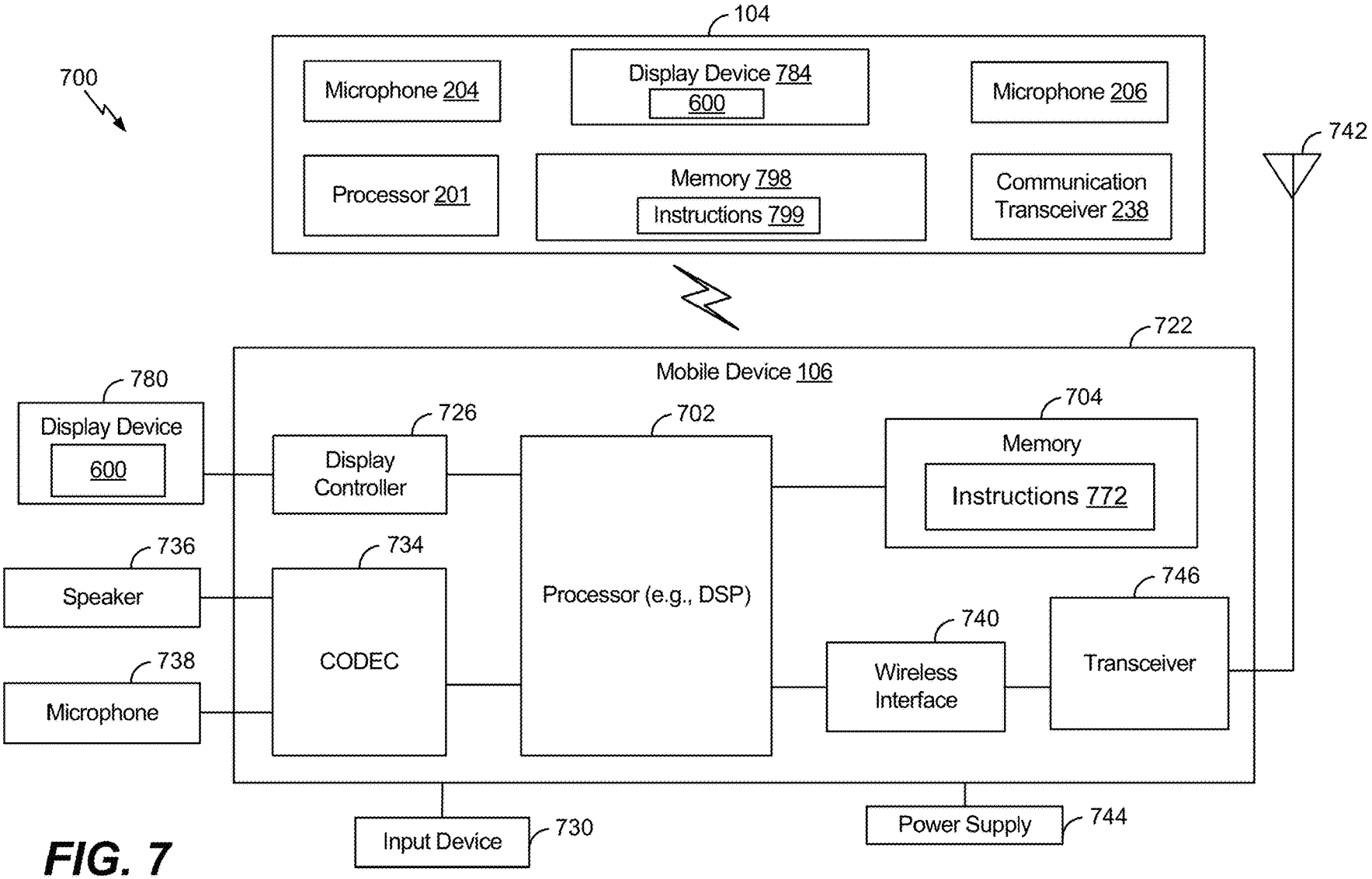
FIG. 7 is a block diagram of a particular illustrative example of a device that includes a wearable device that is operable to perform the techniques described with reference to FIGS. 1-6.

Thus, the graphical user interface 600A enables the user 102 to selectively enable different noise suppression options 602 associated with the wearable device 104A. Although ANC operations and TIR operations are shown in FIG. 6A, in other implementations, other sound options can be controlled through the graphical user interface 600A. Alternatively, or in addition, the graphical user interface 600A can enable variable control of sound options. As a non-limiting example, the amount of noise suppression associated with the ANC operations can be adjusted using a scale. As illustrated in FIG. 7, the graphical user interface 600A can also be integrated into a mobile device that is communicatively coupled to the wearable device 104A.

Figure 6B:
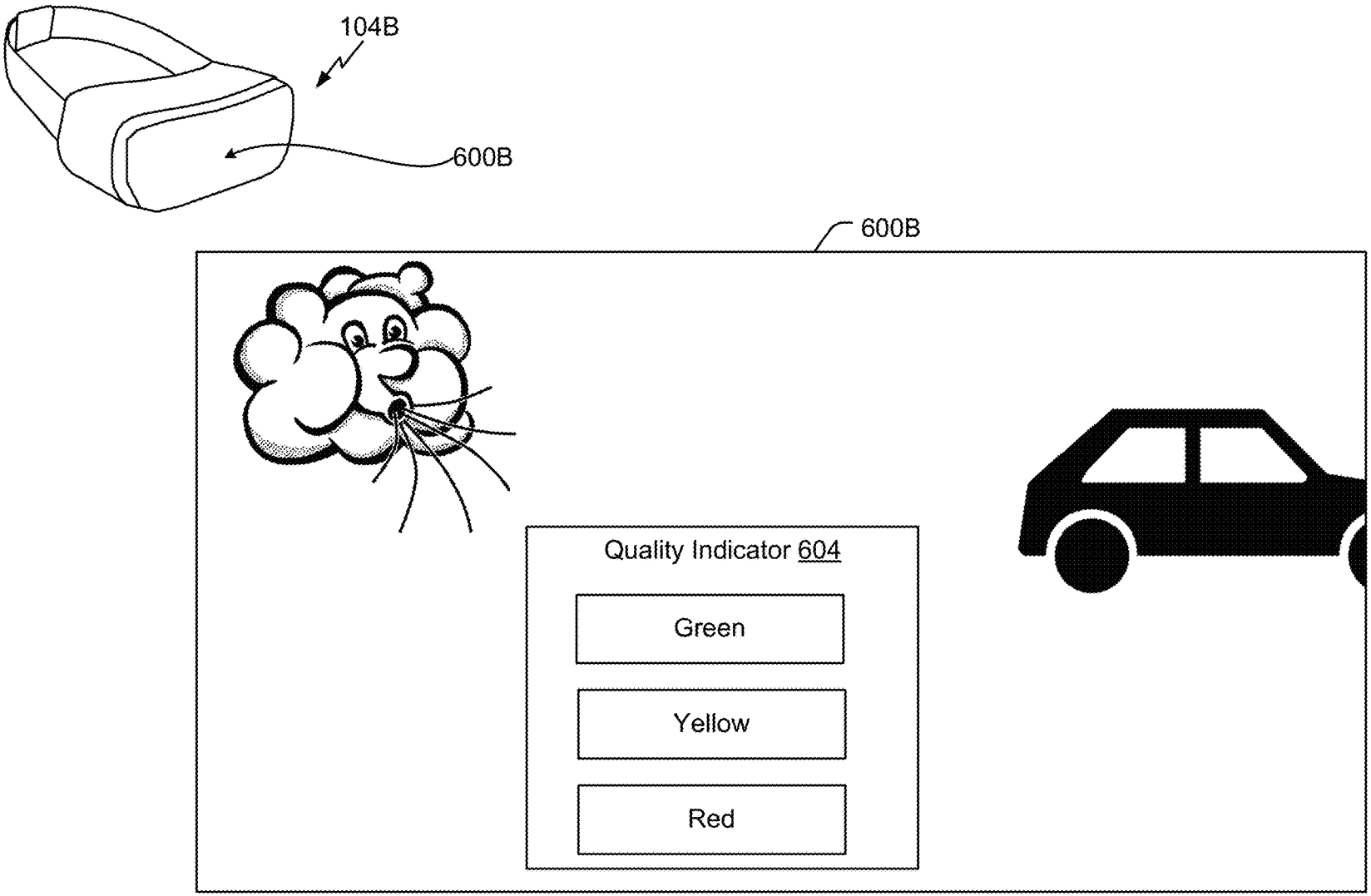
FIG. 6B is another illustrative example of a graphical user interface.

FIG. 6B is another illustrative example of a graphical user interface 600B. The graphical user interface 600B can be integrated into the wearable device 104. As illustrated in FIG. 6B, the graphical user interface 600B can be integrated into a screen of a wearable device 104B. In the illustrated example of FIG. 6B, the wearable device 104B can be a virtual reality headset, an augmented reality headset, or a mixed reality headset.

The graphical user interface 600B displays a quality indicator 604 that is visible to the user 102. The quality indicator 604 indicates a speech quality of the noisy input speech 120C captured by the external microphone 204. As illustrated in FIG. 6B, the quality indicator 604 can display a green light, a yellow light, or a red light. The green light indicates that the speech quality of the noisy input speech 120C is high, the yellow light indicates that the speech quality of the noisy input speech 120C is moderate, and the red light indicates that the speech quality of noisy input speech 120C is low. If the green light is displayed, the user 102 can choose to stay in the environment and continue talking. However, if the red light is displayed, the user 102 may decide to move to a quieter environment.

As described above, the TIR controller 228 can determine the noise characteristic 290 associated with the noisy input speech 120C. Based on the noise characteristic 290, the TIR controller 228 can indicate whether the speech quality of the noisy input speech 120C is high, moderate, or low. For example, if the noise characteristic 290 is below a lower noise threshold, the TIR controller 228 can determine that the speech quality of the noisy input speech 120C is high. If the noise characteristic 290 is above an upper noise threshold, the TIR controller 228 can determine that the speech quality of the noisy input speech 120C is low. If the noise characteristic 290 is between the lower noise threshold and the upper noise threshold, the TIR controller 228 can determine that the speech quality of the noisy input speech 120C is moderate. Thus, based on the noise characteristic 290 determined by the TIR controller 228, the quality indicator 604 displayed at the graphical user interface 600B can indicate the speech quality of the noisy input speech 120C.

Although different colors are used to indicate the speech quality of the noisy input speech 120C, in other implementations, different visual indicators (e.g., numerical values, signal bars, etc.) can be used to indicate the speech quality. As a non-limiting example, if the quality indicator 604 displays a numerical value of one (1), the user 102 can determine that the speech quality of the noisy input speech 120C is low. However, if the quality indicator 604 displays a numerical value of ten (10), the user 102 can determine that the speech quality of the noisy input speech 120C is high.

Figure 6C:
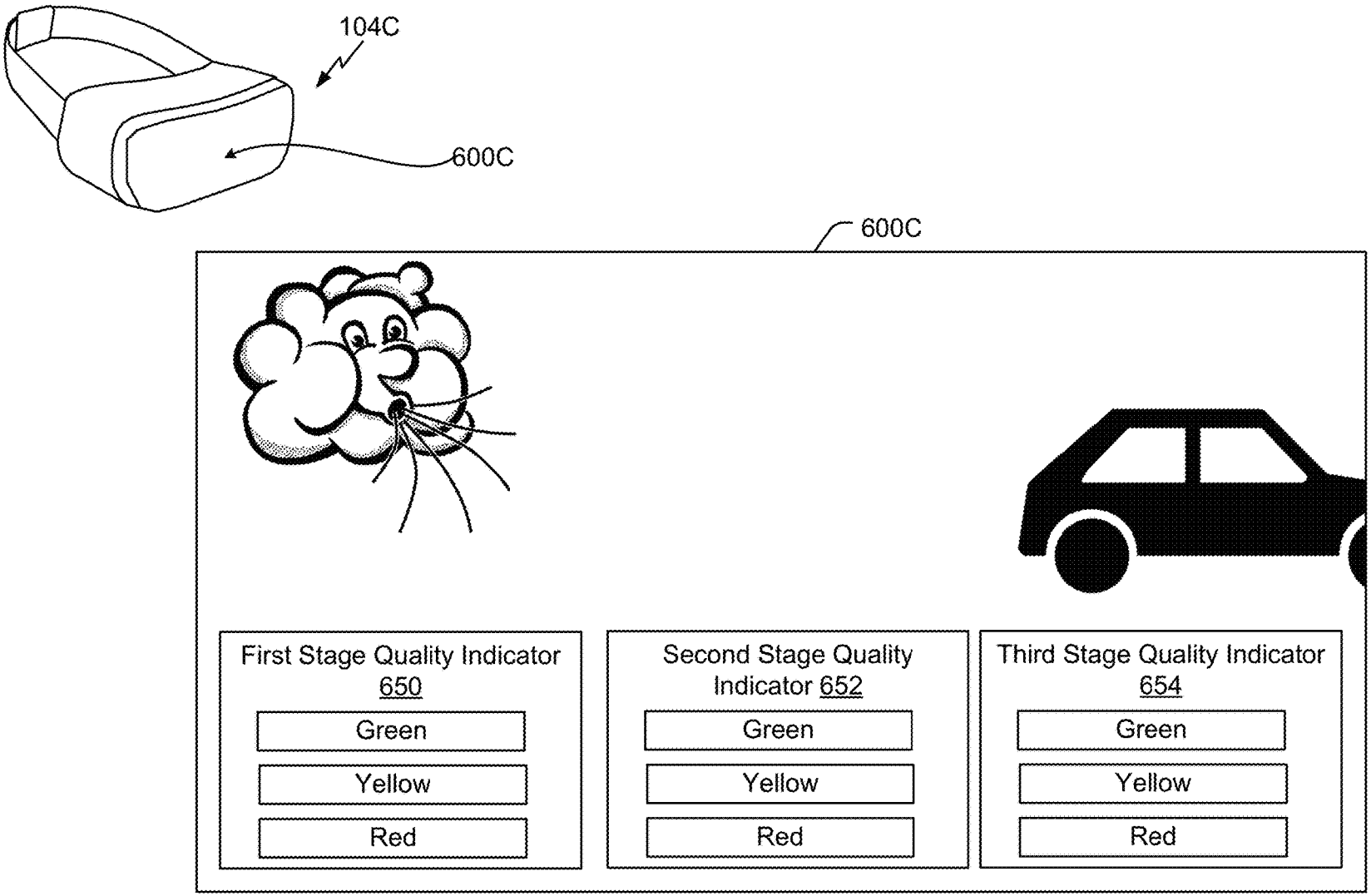
FIG. 6C is another illustrative example of a graphical user interface.

FIG. 6C is another illustrative example of a graphical user interface 600C. The graphical user interface 600C can be integrated into the wearable device 104. As illustrated in FIG. 6C, the graphical user interface 600B can be integrated into a screen of a wearable device 104C. In the illustrated example of FIG. 6C, the wearable device 104C can be a virtual reality headset, an augmented reality headset, or a mixed reality headset.

The graphical user interface 600C displays a first stage quality indicator 650, a second stage quality indicator 652, and a third stage quality indicator 654. Each quality indicator 650, 652, 654 can correspond to the speech quality of the output speech signal 278 based on different microphone configurations. For example, the first stage quality indicator 650 can indicate a speech quality of the output speech signal 278 if the external microphone 204 is activated and the internal microphone 206 is deactivated, the second stage quality indicator 652 can indicate a speech quality of the output speech signal 278 if the external microphone 204 is deactivated and the internal microphone is activated, and the third stage quality indicator 654 can indicate a speech quality of the output speech signal 278 if the external microphone 204 and the internal microphone 206 are activated. In a similar manner as described with respect to FIG. 6B, the speech quality for each stage can be indicated using color indicators.

Figure 6D:
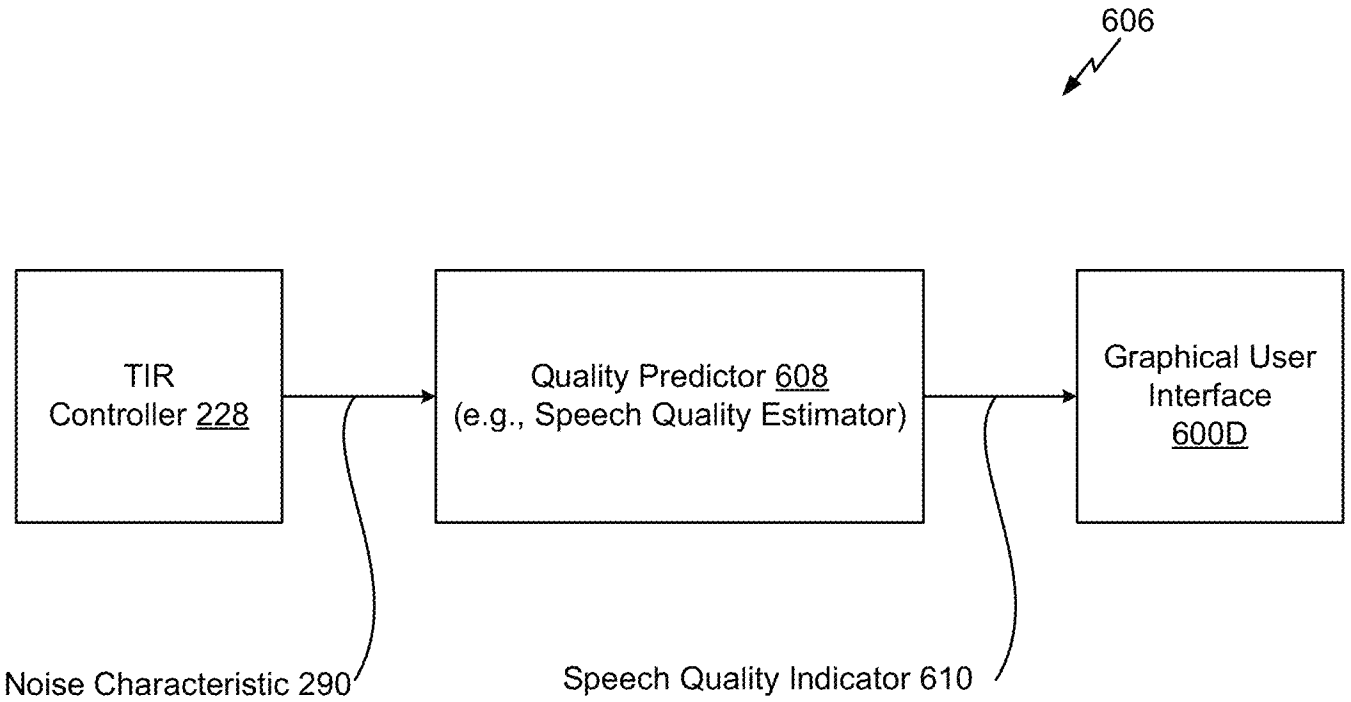
FIG. 6D is an illustrative example of a system that is operable to generate a speech quality indicator to be displayed at a graphical user interface.

FIG. 6D is an illustrative example of a system 606 that is operable to generate a speech quality indicator to be displayed at a graphical user interface. For example, the speech quality indicator can be displayed at the graphical user interface 600A of FIG. 6A, the graphical user interface 600B of FIG. 6B, or the graphical user interface 600C of FIG. 6C. The system 606 includes the TIR controller 228, a quality predictor 608, and a graphical user interface 600D. The graphical user interface 600D can correspond to the graphical user interface 600A of FIG. 6A, the graphical user interface 600B of FIG. 6B, or the graphical user interface 600C of FIG. 6C. According to one implementation, the quality predictor 608 includes a speech quality estimator.

The TIR controller 228 is configured to determine the noise characteristic 290 associated with the noisy input speech 120C. The noise characteristic 290 is provided to the quality predictor 608. Based on the noise characteristic 290, the quality predictor 608 can generate a speech quality indicator 610 that indicates whether the speech quality of the noisy input speech 120C is high, moderate, or low. For example, if the noise characteristic 290 is below a lower noise threshold, the quality predictor 608 can determine that the speech quality of the noisy input speech 120C. If the noise characteristic 290 is above an upper noise threshold, the quality predictor 608 can determine that the speech quality of the noisy input speech 120C is low. If the noise characteristic 290 is between the lower noise threshold and the upper noise threshold, the quality predictor 608 can determine that the speech quality of the noisy input speech 120C is moderate. The speech quality indicator 610 is provided to the graphical user interface 600D. Based on the speech quality indicator 610, the graphical user interface 600D can display a visual representation of the speech quality of the noisy input speech 120C, as depicted in FIG. 6B.

Referring to FIG. 7, a block diagram of a device 700 is shown. According to one implementation, the device 700 is a wireless communication device. The device 700 includes the wearable device 104 that is communicatively coupled to the mobile device 106.

In a particular implementation, the mobile device 106 includes a processor 702, such as a central processing unit (CPU) or a digital signal processor (DSP), coupled to the memory 704. The memory 704 includes instructions 772 (e.g., executable instructions) such as computer-readable instructions or processor-readable instructions. The instructions 772 include one or more instructions that are executable by a computer, such as the processor 702.

The mobile device 106 also includes a display controller 726 that is coupled to the processor 702 and to a display device 780. According to one implementation, the display device 780 can display a graphical user interface 600, such as the graphical user interface 600A of FIG. 6A, the graphical user interface 600B of FIG. 6B, the graphical user interface 600C of FIG. 6C, or the graphical user interface 600D of FIG. 6D. A coder/decoder (CODEC) 734 is also coupled to the processor 702. A speaker 736 and a microphone 738 are coupled to the CODEC 734. A wireless interface 740 is coupled to the processor 702, and an antenna 742 is coupled to the wireless interface 740 via a transceiver 746.

In some implementations, the processor 702, the display controller 726, the memory 704, the CODEC 734, the wireless interface 740, and the transceiver 746 are included in a system-in-package or system-on-chip device 722. In some implementations, a power supply 744 and an input device 730 are coupled to the system-on-chip device 722. Moreover, in a particular implementation, as illustrated in FIG. 7, the display device 780, the microphone 738, the speaker 736, the antenna 742, and the power supply 744 are external to the system-on-chip device 722.

The wearable device 104 is in communication with the mobile device 106 via the communication transceiver 238. For example, the communication transceiver 238 is configured to send the time-domain output speech signal 280 to the mobile device 106, and the communication transceiver 238 is configured to receive the output audio signal 258 from the mobile device 106. The wearable device 104 can include one or more components of the systems 200A-400 of FIGS. 2A-4. As illustrated in FIG. 7, the wearable device 104 includes the processor 201 and the microphones 204, 206, in addition to the communication transceiver 238. The wearable device 104 can also include other components within the systems 200A-400 of FIGS. 2A-4. In FIG. 7, the wearable device 104 also includes a memory 798. The memory 798 includes instructions 799 that are executable by the processor 201 to perform the method 500 of FIG. 5. The memory 798 includes or corresponds to a non-transitory computer readable medium storing the instructions 799. In FIG. 7, the wearable device 104 also includes a display device 784. According to one implementation, the display device 784 can display the graphical user interface 600.

In a particular implementation, one or more components of the systems and devices disclosed herein is integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a wearable device includes first means for capturing noisy input speech. For example, the first means for capturing may include the microphone 204, one or more other devices, circuits, modules, or any combination thereof.

The wearable device also includes second means for capturing the noisy input speech. The second means for capturing is configured to be positioned within a threshold distance of an ear canal of a user. For example, the second means for capturing may include the microphone 206, one or more other devices, circuits, modules, or any combination thereof.

The wearable device also includes means for performing an ANC operation on the noisy input speech as captured by the first means for capturing, the noisy input speech as captured by the second means for capturing, or both, to suppress a noise level associated with the noisy input speech as captured by the second means for capturing. For example, the means for performing the ANC operation may include the ANC circuit 302, the feedback ANC circuit 306, the feedforward ANC circuit 304, the instructions 799 executable by the processor 201, the ANC circuit 154, the processor 152, one or more other devices, circuits, modules, or any combination thereof.

The wearable device also includes means for matching a second frequency spectrum of a second signal with a first frequency spectrum of a first signal. The first signal is representative of the noisy input speech as captured by the first means for capturing, and the second signal is representative of the noisy input speech as captured by the second means for capturing. For example, the means for matching may include the equalizer 230, the control unit 234, the instructions 799 executable by the processor 201, the spectrum matching circuit 156, the processor 152, one or more other devices, circuits, modules, or any combination thereof.

The wearable device also includes means for generating an output speech signal that is representative of input speech based on the second signal having the second frequency spectrum that matches the first frequency spectrum. For example, the means for generating may include the control unit 234, the instructions 799 executable by the processor 201, the output signal generator 158, the processor 152, one or more other devices, circuits, modules, or any combination thereof.

The wearable device also includes means for transmitting a time-domain version of the output speech signal to a mobile device. For example, the means for transmitting may include the communication transceiver 238, one or more other devices, circuits, modules, or any combination thereof.

In accordance with one or more techniques of this disclosure, the mobile device may be used to acquire a sound field. For instance, the mobile device may acquire a sound field via the wired and/or wireless acquisition devices and/or the on-device surround sound capture (e.g., a plurality of microphones integrated into the mobile device). The mobile device may then code the acquired sound field into the Higher Order Ambisonic (HOA) coefficients for playback by one or more of the playback elements. For instance, a user of the mobile device may record (acquire a sound field of) a live event (e.g., a meeting, a conference, a play, a concert, etc.), and code the recording into HOA coefficients.

The mobile device may also utilize one or more of the playback elements to playback the HOA coded sound field. For instance, the mobile device may decode the HOA coded sound field and output a signal to one or more of the playback elements that causes the one or more of the playback elements to recreate the sound field. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D sound field and playback the same 3D sound field at a later time. In some examples, the mobile device may acquire a 3D sound field, encode the 3D sound field into HOA, and transmit the encoded 3D sound field to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a sound field for playback by the delivery systems.

The mobile device may also, in some instances, include a plurality of microphones that are collectively configured to record a 3D sound field. In other words, the plurality of microphone may have X, Y, Z diversity. In some examples, the mobile device may include a microphone which may be rotated to provide X, Y, Z diversity with respect to one or more other microphones of the mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D sound field. In accordance with one or more techniques of this disclosure, a single generic representation of a sound field may be utilized to render the sound field on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a sound field may be utilized to render the sound field on any of the foregoing playback environments. Additionally, the techniques of this disclosure enable a rendered to render a sound field from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other speakers such that playback may be achieved on a 6.1 speaker playback environment.

Moreover, a user may watch a sports game while wearing headphones. In accordance with one or more techniques of this disclosure, the 3D sound field of the sports game may be acquired (e.g., one or more Eigen microphones may be placed in and/or around the baseball stadium), HOA coefficients corresponding to the 3D sound field may be obtained and transmitted to a decoder, the decoder may reconstruct the 3D sound field based on the HOA coefficients and output the reconstructed 3D sound field to a renderer, the renderer may obtain an indication as to the type of playback environment (e.g., headphones), and render the reconstructed 3D sound field into signals that cause the headphones to output a representation of the 3D sound field of the sports game.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

a memory; and one or more processors coupled to the memory, the one or more processors configured to:

perform an active noise cancellation (ANC) operation on noisy input speech as captured by a first microphone, the noisy input speech as captured by a second microphone, or both, to suppress a noise level associated with the noisy input speech as captured by the second microphone;

match a second frequency spectrum of a second signal with a first frequency spectrum of a first signal, the first signal representative of the noisy input speech as captured by the first microphone, and the second signal representative of the noisy input speech as captured by the second microphone; and generate an output speech signal that is representative of input speech based on the second signal having the second frequency spectrum that matches the first frequency spectrum.

2. The device of claim 1, further comprising:

the first microphone coupled to the one or more processors; and the second microphone coupled to the one or more processors, the second microphone configured to be positioned within a threshold distance of an ear canal of a user.

3. The device of claim 1, further comprising a communication transceiver coupled to the one or more processors, the communication transceiver configured to transmit a time-domain version of the output speech signal to a mobile device.

4. The device of claim 1, wherein the ANC operation comprises at least one of a feedforward ANC operation on the noisy input speech as captured by the first microphone or a feedback ANC operation on the noisy input speech as captured by the second microphone.

5. The device of claim 1, further comprising an equalizer integrated into the one or more processors and configured to match the second frequency spectrum with the first frequency spectrum.

6. The device of claim 5, wherein the equalizer comprises a frequency-domain adaptive filter.

7. The device of claim 1, wherein the memory and the one or more processors are integrated into one of a virtual reality headset, an augmented reality headset, a mixed reality headset, a head-mounted display, or a headset.

8. The device of claim 1, wherein the one or more processors are further configured to:

determine a noise characteristic associated with the noisy input speech as captured by the first microphone; and generate a control signal based on the noise characteristic to indicate how to use the first signal and the second signal in generation of the output speech signal.

9. The device of claim 8, wherein the one or more processors are further configured to determine that the noise characteristic satisfies an upper noise threshold, and wherein, in response to the determination that the noise characteristic satisfies the upper noise threshold, the control signal indicates to:

generate the output speech signal based on the second signal; and bypass use of the first signal to generate the output speech signal.

10. The device of claim 8, wherein the one or more processors are further configured to determine that the noise characteristic satisfies a lower noise threshold and fails to satisfy an upper noise threshold, and wherein, in response to the determination that the noise characteristic satisfies the lower noise threshold and fails to satisfy the upper noise threshold, the control signal indicates to generate the output speech signal based on the first signal and the second signal.

11. The device of claim 10, wherein the one or more processors are further configured to perform a frequency extension operation on the second signal to generate a frequency-extended version of the second signal.

12. The device of claim 11, wherein the one or more processors are configured to:

scale the first signal by a first scaling factor to generate a first portion of the output speech signal, the first scaling factor based on the noise characteristic;

scale the frequency-extended version of the second signal by a second scaling factor to generate a second portion of the output speech signal, the second scaling factor based on the noise characteristic; and combine the first portion of the output speech signal and the second portion of the output speech signal to generate the output speech signal.

13. The device of claim 1, wherein the one or more processors are configured to:

determine a noise characteristic associated with the noisy input speech as captured by the first microphone; and generate, based on the noise characteristic and neural network data, the control signal, a control signal to indicate how to use the first signal and the second signal in generation of the output speech signal.

14. The device of claim 1, wherein the one or more processors are configured to perform an inverse transform operation on the output speech signal to generate a time-domain version of the output speech signal.

15. The device of claim 1, further comprising a third microphone coupled to the one or more processors and configured to capture the noisy input speech, and wherein the one or more processors are further configured to perform a feedforward ANC operation on the noisy input speech as captured by the third microphone.

16. The device of claim 1, further comprising a graphical user interface coupled to the one or more processors and configured to present an option to disable the ANC operation.

17. A method for suppressing noise associated with speech, the method comprising:

performing an active noise cancellation (ANC) operation on noisy input speech as captured by a first microphone of a wearable device, the noisy input speech as captured by a second microphone of the wearable device, or both, to suppress a noise level associated with the noisy input speech as captured by the second microphone, wherein the second microphone is positioned within a threshold distance of an ear canal of a user;

performing an equalization operation to match a second frequency spectrum of a second signal with a first frequency spectrum of a first signal, the first signal representative of the noisy input speech as captured by the first microphone, and the second signal representative of the noisy input speech as captured by the second microphone;

generating an output speech signal that is representative of input speech based on the second signal having the second frequency spectrum that matches the first frequency spectrum; and transmitting a time-domain version of the output speech signal to a mobile device.

18. The method of claim 17, wherein performing the ANC operation comprises at least one of:

performing a feedforward ANC operation on the noisy input speech as captured by the first microphone; or performing a feedback ANC operation on the noisy input speech as captured by the second microphone.

19. The method of claim 17, wherein the wearable device comprises one of a virtual reality headset, an augmented reality headset, a mixed reality headset, a head-mounted display, or a headset.

20. The method of claim 17, further comprising:

determining a noise characteristic associated with the noisy input speech as captured by the first microphone; and generating a control signal based on the noise characteristic, the control signal indicating how to use the first signal and the second signal in generation of the output speech signal.

21. The method of claim 20, further comprising determining that the noise characteristic satisfies an upper noise threshold, and wherein, in response to the determining that the noise characteristic satisfies the upper noise threshold, the control signal indicates to:

generate the output speech signal based on the second signal; and bypass use of the first signal to generate the output speech signal.

22. The method of claim 20, further comprising determining that the noise characteristic satisfies a lower noise threshold and fails to satisfy an upper noise threshold, and wherein, in response to determining that the noise characteristic satisfies the lower noise threshold and fails to satisfy the upper noise threshold, the control signal indicates to generate the output speech signal based on the first signal and the second signal.

23. The method of claim 22, further comprising performing a frequency extension operation on the second signal to generate a frequency-extended version of the second signal.

24. The method of claim 23, further comprising:

scaling the first signal by a first scaling factor to generate a first portion of the output speech signal, the first scaling factor based on the noise characteristic;

scaling the frequency-extended version of the second signal by a second scaling factor to generate a second portion of the output speech signal, the second scaling factor based on the noise characteristic; and combining the first portion of the output speech signal and the second portion of the output speech signal to generate the output speech signal.

25. The method of claim 17, further comprising performing an inverse transform operation on the output speech signal to generate the time-domain version of the output speech signal.

26. A non-transitory computer-readable medium comprising instructions for suppressing noise associated with speech, the instructions, when executed by one or more processors within a wearable device, cause the one or more processors to:

perform an active noise cancellation (ANC) operation on noisy input speech as captured by a first microphone of a wearable device, the noisy input speech as captured by a second microphone of the wearable device, or both, to suppress a noise level associated with the noisy input speech as captured by the second microphone, wherein the second microphone is positioned within a threshold distance of an ear canal of a user;

perform an equalization operation to match a second frequency spectrum of a second signal with a first frequency spectrum of a first signal, the first signal representative of the noisy input speech as captured by the first microphone, and the second signal representative of the noisy input speech as captured by the second microphone; and generate an output speech signal that is representative of input speech based on the second signal having the second frequency spectrum that matches the first frequency spectrum.

27. The non-transitory computer-readable medium of claim 26, wherein performance of the ANC operation comprises at least one of:

performance of a feedforward ANC operation on the noisy input speech as captured by the first microphone; or performance of a feedback ANC operation on the noisy input speech as captured by the second microphone.

28. A wearable device comprising:

first means for capturing noisy input speech;

second means for capturing the noisy input speech, the second means for capturing configured to be positioned within a threshold distance of an ear canal of a user;

means for performing an active noise cancellation (ANC) operation on the noisy input speech as captured by the first means for capturing, the noisy input speech as captured by the second means for capturing, or both, to suppress a noise level associated with the noisy input speech as captured by the second means for capturing;

means for matching a second frequency spectrum of a second signal with a first frequency spectrum of a first signal, the first signal representative of the noisy input speech as captured by the first means for capturing, and the second signal representative of the noisy input speech as captured by the second means for capturing;

means for generating an output speech signal that is representative of input speech based on the second signal having the second frequency spectrum that matches the first frequency spectrum; and means for transmitting a time-domain version of the output speech signal to a mobile device.

29. The wearable device of claim 28, wherein the means for performing the ANC operation comprises at least one of:

means for performing a feedforward ANC operation on the noisy input speech as captured by the first means for capturing; or means for performing a feedback ANC operation on the noisy input speech as captured by the second means for capturing.

30. The wearable device of claim 28, the first means for capturing, the second means for capturing, the means for performing, the means for matching, the means for generating, and the means for transmitting are integrated into one of a virtual reality headset, an augmented reality headset, a mixed reality headset, a head-mounted display, or a headset.

* * * * *